US009981197B2

(12) United States Patent
Akavia et al.

(10) Patent No.: US 9,981,197 B2
(45) Date of Patent: May 29, 2018

(54) CONNECTED KITCHEN TOY DEVICE

(71) Applicant: Seebo Interactive, Ltd., Tel Aviv (IL)

(72) Inventors: Lior Akavia, Tel Aviv (IL); Liran Akavia, Tel Aviv (IL); Lee Winfeild, Tel Aviv (IL); Yarden Hod, Tel Aviv (IL)

(73) Assignee: Seebo Interactive, Ltd., Tel Aviv (IL)

( * ) Notice: Subject to any disclaimer, the term of this patent is extended or adjusted under 35 U.S.C. 154(b) by 0 days. days.

(21) Appl. No.: 15/116,987

(22) PCT Filed: Feb. 6, 2015

(86) PCT No.: PCT/IL2015/050141

§ 371 (c)(1),
(2) Date: Aug. 5, 2016

(87) PCT Pub. No.: WO2015/118545

PCT Pub. Date: Aug. 13, 2015

(65) Prior Publication Data

US 2017/0173489 A1 Jun. 22, 2017

Related U.S. Application Data

(60) Provisional application No. 61/936,352, filed on Feb. 6, 2014, provisional application No. 61/937,858, filed on Feb. 10, 2014.

(51) Int. Cl.
*A63H 33/26* (2006.01)
*A63H 33/30* (2006.01)

(52) U.S. Cl.
CPC ..... *A63H 33/3055* (2013.01); *A63H 2200/00* (2013.01)

(58) Field of Classification Search
CPC ... A63H 3/00; A63H 3/28; A63H 3/36; A63H 17/26; A63H 17/32; A63H 30/00;
(Continued)

(56) References Cited

U.S. PATENT DOCUMENTS 4,333,258 A 6/1982 McCaslin
5,853,327 A 12/1998 Gilboa
(Continued)

FOREIGN PATENT DOCUMENTS

WO 0015316 3/2000

*Primary Examiner* — Kien Nguyen
(74) *Attorney, Agent, or Firm* — Maxwell L. Minch; GrayRobinson, P.A.

(57) ABSTRACT

The subject matter disclosed herein is directed to a connected kitchen toy device configured to allow a player to imitate cooking in a real kitchen, wherein an action performed by the player on the kitchen toy device is identified by and creates a simultaneous reaction on a smart device connected to said kitchen toy and/or on the kitchen toy device itself. The kitchen toy device comprises at least one input element and one output element, and a communication module for allowing bi-directional communication between the kitchen toy and the smart device. The action performed by the player on the kitchen toy device is identified by at least one input element positioned on the kitchen toy and/or on the smart device, wherein the action results in creation of at least one output reaction on either one of said kitchen toy device, smart device, or on both. The action may be performed on at least one playing item positioned on the kitchen toy device or held in its vicinity, wherein the action performed by the player and the at least one playing item are both identified and displayed on the smart device and further create a reaction on either one of the kitchen toy device, the playing item, the smart device, and combinations thereof.

21 Claims, 12 Drawing Sheets

(58) Field of Classification Search
CPC ..... A63H 30/04; A63H 33/00; A63H 33/26; A63H 2200/00
USPC ..... 446/479–482, 484
See application file for complete search history.

(56) References Cited

U.S. PATENT DOCUMENTS

| | | | | |
|---|---|---|---|---|
| 6,937,152 | B2 * | 8/2005 | Small | A63H 33/26 340/323 R |
| 2008/0081694 | A1 | 4/2008 | Hong et al. | |
| 2011/0009175 | A1 | 1/2011 | Raichman et al. | |
| 2011/0028219 | A1 | 2/2011 | Heatherly et al. | |
| 2012/0049453 | A1 | 3/2012 | Morichau-Beauchant et al. | |
| 2013/0072083 | A1 * | 3/2013 | Ghaly | A63H 3/52 446/91 |
| 2013/0196766 | A1 | 8/2013 | Leyland et al. | |

* cited by examiner

CONNECTED KITCHEN TOY DEVICE

FIELD OF THE INVENTION

The invention relates generally to the field of connected toys. More specifically, the invention is directed to a connected kitchen toy device having unique technical features that provides the user a tactual experience of a real kitchen.

BACKGROUND OF THE INVENTION

Physical toys containing electronic components are, traditionally named 'electronic toys' and are commonly seen in the average household of the 21st century. In the last few years, a new trend seems to be emerging, of connecting these electronic toys to software applications and/or to the internet. This trend is generally named the "Internet of things" and describes the general tendency to connect various consumer products to the internet and to a user's smart devices (for more details: http://en.wikipedia.org/wiki/Internet_of_Things).

In the past several years, there have been many developments in the field of connected toys, and many connected toys are seen around. WO/2013/024470 of the same inventors, incorporated herein by reference, discloses a connected multifunctional toy system for providing a user a learning experience, entertaining experience, and a social experience. The connection of toys to software programs, to websites and/or servers, allows the toys to become "smarter" and more dynamic. Another example of a connected toy is the Furby toy from Hasbro that connects to the web indirectly (http://www.hasbro.com/furby/en_US/#panel_talk). This toy can connect to tablets and smartphones through encoded sound frequencies. The connection allows the user to feed his Furby toy with different dishes, record a video of them playing together and the like. Other examples for connected toys are various products by Apptoyz™ (http://www.apptoyz.com/shop/), which were designed to work with tablets and smartphones. These products include a plastic toy and a suitable application to match the plastic toy. The product line includes AppGear (a simple plastic car wheel which is used as a case for smartphones and tablets), AppCopter (RC helicopter controlled by smartphones and tablets), AppBlaster (a simple plastic gun which controls the smartphone mechanically by an arm that taps the screen every time the user pulls the trigger), AppQuiz, with the same mechanical solution (an arm taps the screen every time the user pushes the answer buttons), and the like. The key characteristic of these products is a very simple connection (and sometimes only mechanical) between the toy and the software App.

Kitchen toys are well known in the art. These kitchens give children a fun experience of playing pretend with a toy, usually designed as close to reality as possible to give the child a miniature experience of "mommy's kitchen". Two popular companies that provide such non connected kitchens are Smoby toys™ (http://www.smoby.com/en/roleplay/kitchen/kitchens.html) and by Kidskraft™ (http://www.kidkraft.com/toys-and-playsets/kitchens). Some of the companies create toy brands with real kitchen brands, such as Tefal™ toy kitchens. These toys give a nice playing experience to the child, but they lack the feeling of objects morphing their shape and colour, as happens in real kitchens during the cooking/baking process. For example, an egg which morphs into an omelette, vegetables morphing into soup, pizza with melting cheese, water changing colour upon making a cup of tea, and the like. All of these things happen only in the child's imagination. In addition, the creation of recipes and the educational value of the unconnected kitchens is very limited, as the child only uses his imagination in order to play the game, without further instructions about healthy food, how dishes are really created, and without any guidance or encouragement for accurate actions that are made.

Concurrently, a wide variety of cooking, baking and drink making software games for children have emerged in recent years, all emphasizing these sides of play. Examples of kitchen games and cooking interactivity can be found for example in Google appstore, Apple App store, and others such as Toca Boca™ (http://tocaboca.com/app/toca-kitchen-2/). These apps allow young players to experience cooking in a very vivid way, for example by watching a tomato being roasted on the grill and observing as it changes its colour and shape to that of a roasted tomato. The child may boil water and see the bubbles coming up, bake, and fry and even put things in the microwave, all in a virtual manner with his fingers playing on the screen of the smart device or by using a computer mouse. In addition, a few characters appear on screen to give culinary feedback of the cooking, and give negative feedback if the food is not tasty (for example: burnt).

Another example is the cooking mama games by Majesco™ (http://www.cookingmamaus.com/), in which the app instructs the players how to cook specific dishes, and gives them points on their performance in preparing the dish. The app software is further operable with PlayStation™ and Wii™. In the Wii version, the player may make some physical activity to operate the game, for example: chop vegetables with the Wii remote and flip a pan with the Wii remote. However, in both of examples, as well as in other cooking application games, the game lacks the fun and experience of playing with physical toys, and more specifically, the experience of playing with a physical kitchen that resembles "mommy's kitchen". In addition, it lacks the experience of putting these ingredients in some tangible space (in a pot, on the stove, in the oven), which provide the child with a more realistic experience of play.

Another example of a kitchen toy that may be relevant to the field of the invention is described in http://www.plumproducts.com/plum-snowdrop-interactive-wooden-play-kitchen.html. In this example, the physical experience is very limited and the child doesn't get any response for activities he performs in the kitchen.

In contrast to the prior art kitchens described above, the connected toy kitchen provided herein provides the child a unique experience of play and unique simulation of cooking in a real kitchen. The invention is directed to a connected toy kitchen comprising novel technical and electrical features that allows the player to simulate a real cooking experience and combine physical experience with a virtual one.

SUMMARY OF THE INVENTION

The subject matter disclosed herein is directed to a connected kitchen toy device configured to allow a player to imitate cooking in a real kitchen, wherein an action performed by the player on the kitchen toy device is identified by and creates a simultaneous reaction on a smart device connected to said kitchen toy and/or on the kitchen toy device itself. The kitchen toy device comprises at least one input element and one output element, and a communication module for allowing bi-directional communication between the kitchen toy and the smart device. The action performed by the player on the kitchen toy device is identified by at least one input element positioned on the kitchen toy and/or on the smart device, wherein the action results in creation of at least one output reaction on either one of said kitchen toy device, smart device, or on both.

The action may be performed on at least one playing item positioned on the kitchen toy device or held in its vicinity, wherein the action performed by the player and the at least one playing item are both identified and displayed on the smart device and further create a reaction on either one of the kitchen toy device, the playing item, the smart device, and combinations thereof.

A playing item in accordance with the present invention is an object that comprises at least an identification element configured to allow its recognition by identification means positioned on the kitchen toy device, and wherein upon identification of said playing item it is displayed on said smart device screen. A playing item may further comprise output elements such as but not limited to, LED, buzzer, mechanical elements that allows movement of parts thereof. A detailed discerption of playing items and their characters are provided below.

BRIEF DESCRIPTION OF THE DRAWINGS

FIG. 2A-2H are schematic illustrations of some examples of optional sets of playing items sets for playing with the connected kitchen toy device 100 of FIG. 1, wherein FIG. 2A illustrates breads and bread rolls, a cutting board and a knife for preparing sandwiches; FIG. 2B illustrates various vegetables with a cutting board and a knife for preparing a salad or slice the vegetables; FIG. 2C illustrates a connected baking set with some baking instruments and ingredients; FIG. 2D is an illustration of a pizza preparing set and accompanying accessories such as a pizza cutter and a seasoning salt shaker for pizza such as oregano and garlic mix; FIG. 2E illustrate a connected set of tools for the kitchen that comprises a motion sensor configured to allow recognition of the movement of the tool in real time; FIG. 2F is a schematic illustration of some home used electrical appliances for the kitchen; FIG. 2G is a schematic illustration of baking products including some cakes, cookies and cupcakes; FIG. 2H is a schematic illustration of a kit for preparing a vegetables soup arranged in a basket. The kit comprises a pot, a water bottle, tomato, zucchini, carrot, stiffing spoon, salt and pepper, and a basket.

FIGS. 5A-5B depict an example of a connected kitchen toy for dolls and a connected doll that may be a stand-alone kit of kitchen and accessories for dolls, or a part of a connected doll house, wherein FIG. 3A illustrates the connected kitchen toy and the doll, and FIG. 3B illustrates a smart device reflecting the connected doll standing in the connected kitchen.

DETAILED DESCRIPTION OF EMBODIMENTS

Figure 1:
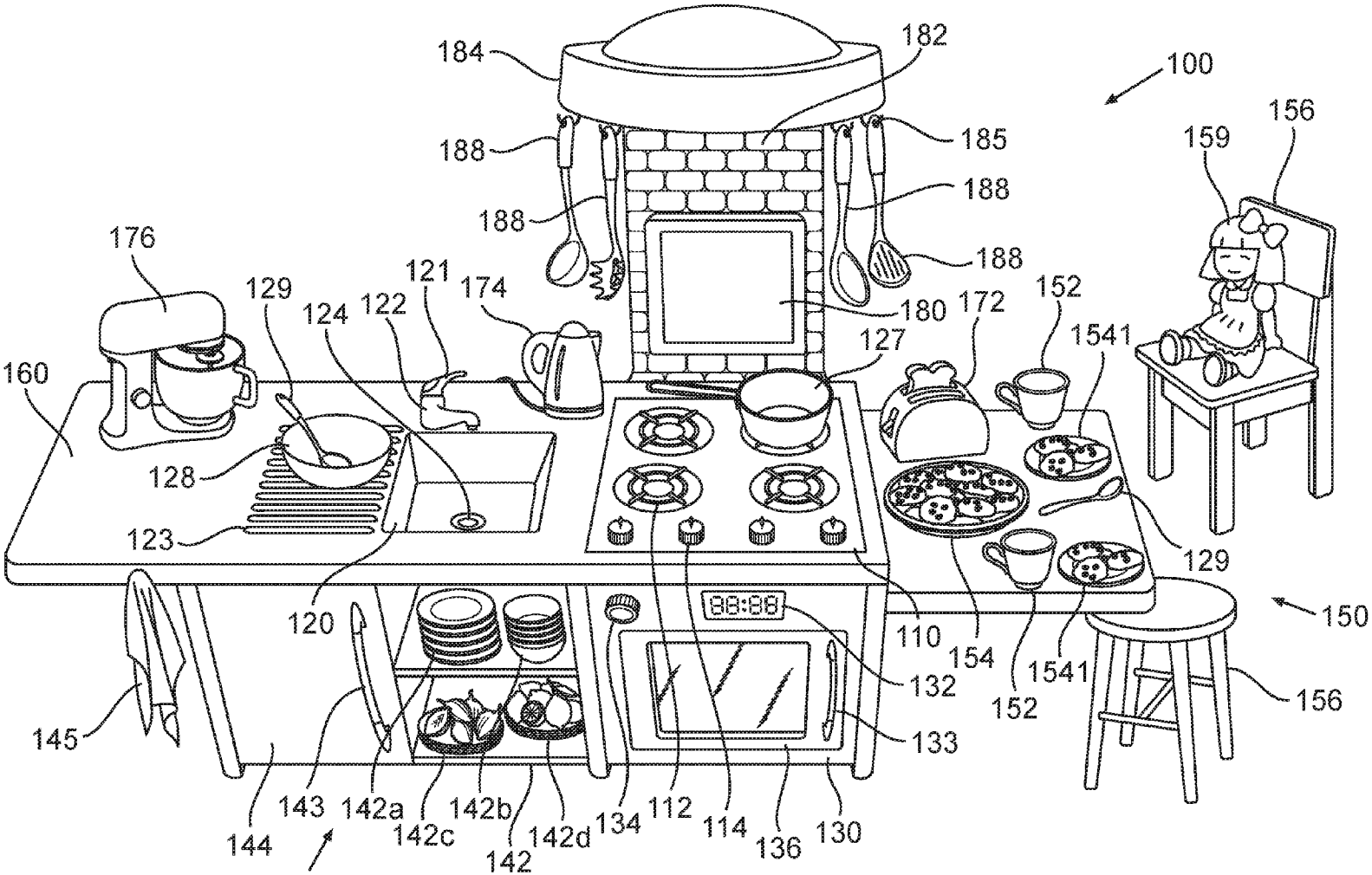
FIG. 1 is a schematic illustration of an example of a connected kitchen toy with identifiable connected playing item.

The subject matter described herein is directed to a connected toy kitchen having a unique hardware implemented inside the toy, which allows it to connect to smart devices, and to simulate a real experience of cooking. The connected toy kitchen device further allows a bidirectional connection between the physical toy and the smart device in a unique, sophisticated, and dynamic manner, and to combine teaching with entertainment in a fun and amusing way. In the following description the terms "player" and "child" are used interchangeably and both describes the user that plays with the toy kitchen. It should be clear that although the description generally refers to a single player, more than one player may play with the connected toy kitchen of the invention simultaneously, wherein the players may be two or more children, or children and adults, such as a parent and at least one child.

In accordance with variations of the invention, the connected kitchen toy comprises input/output elements (hereinafter denoted: "I/O elements"), such as, but not limited to, buttons, LEDs, potentiometers, piezoelectric sensors, touch sensors, smell sensors, light sensor, buzzer, speaker, microphone, and various identification sensors available in the market.

Identification of play items and actions performed by the player on the kitchen toy device and/or on the play items may be obtained by using known technologies such as but not limited to: RFID, NFC, capacitive sensors, hotspots, ultrasonic triangulation based sensors, sensors based on energy harvesting, weight sensors, photo-sensors, color sensors, a camera, and combination thereof of two or more of the above sensing technologies. The identification sensors may be implemented in several areas in the kitchen: under the stove, under a shelf in the oven, within the toy microwave, within the toy sink and the like, according to the structure of the kitchen toy and the accompanying playing items. Upon placing each of the identified playing items, a signal is sent to the smart device, and the playing item is identified.

The connected kitchen toy device of the invention may contain various identification acceptable technologies. Some non-limiting examples of such technologies are: RFID, NFC, hotspots, gated button, color sensing, QR and barcode, image recognition, and Hall Effect sensor.

The smart device on its end comprises a dedicated software application configured to connect to the kitchen toy, so as to allow the child a unique and innovative playing pattern with dynamic and reach contents and simulation of real actions performed by the player.

The connected kitchen toy device comprises various electrical components and electronic circuits, including, without limitation, a communication module that functionally allows it to become an electrical connected toy having ability to connect with smart devices, namely, electronic devices that have the ability to receive and transmit data to and from the kitchen toy device, and further to playing items as will be described in details below, either by a wired connection or by wireless communication methods known in the art (such as but not limited to Bluetooth, BLE, and Wi-Fi). The smart device comprises a dedicated software application (app) installed on it.

In accordance with the invention, the connected kitchen toy and smart device are configured to identify various playing items as described in details with reference to the figures. The identifiable playing items preferably comprise at least one tag that allows its recognition. In accordance with implementation of the invention, the identifiable playing items differ from each other in a manner that some of the items may contain identifying means that allows their recognition by the kitchen toy and the smart device, while others may further comprise sensor/s configured to allow recognition of the specific usage of the item in real time and imaging of the actions of the player with the specific playing item on the smart device. In some variations, the app may instruct the player to perform an action with the playing item, for example, to instruct the child to turn on the stove (e.g., press a button on the physical toy), or to cease an action that the child is doing with the playing item, such as an instruction to take a cake out of an oven. The application may further wait for a feedback from input sensors that an action did occur as instructed (e.g., the cake identification tag is no longer identified by the identification in the oven), and produce an appropriate reaction. The reaction can be a direct response, coming from the smart device itself, such as a visual response on the smart device's screen (e.g. animation, illustration, motion picture and the like), and/or an audio response (e.g. positive sound effect, background sounds, music and the like). Additionally or alternatively, the smart device may send a feedback back to the kitchen toy device, and then the kitchen toy itself may produce an appropriate reaction by output elements that are implemented in the toy, such as visual output sensors (LEDS, light bulb, screens and the like), audio sensors (such as speakers, buzzers and the like), odor response (such as a scent diffuser), and a mechanical output that create a movement of the playing item upon instructions received from the smart device and/or the kitchen toy device.

The I/O elements that are implemented inside the kitchen toy device may send signals to the dedicated application, or they may send internal signals and produce response inside the toy itself; for example, upon pressing on a button in the kitchen, it may provoke a LED to light up on the kitchen toy device in a direct channel. The button may also provoke a response on the smart device, or provoke a response on the physical toy in an indirect channel, as described above such as sending a feedback to the app that the button was pressed, which it turn operates the LED in a specific blinking pattern. The indirect channel may allow a more complex reaction to happen in the output sensors; the application may control the output and execute a variety of responses corresponding to different sequences of actions. For example, if the fire button was pressed before the pot was placed on the stove; the app may present a different feedback than in an alternative situation, in which the fire button was pressed after the pot was placed. This variety of reactions of the I/O elements may contribute to the game in different ways, and introduce new ways of play.

The kitchen toy device comprises at least one type of identification sensors and preferably, a mixture of various types of identification sensors, configured to allow identification of identifiable playing items (peripheral accessories), such as, but not limited to, kitchen tools, food products and food ingredients, and electrical home use appliances for the kitchen. The electrical appliances may be an integral part of the toy kitchen device or separated therefrom. For example, a toaster may be a separated playing item or may be attached to the kitchen toy device. The kitchen toy device comprises hardware, which is connected to the I/O elements, and more specifically, but not limited to, to the identification sensors, thus allowing identification of the playing items when they are placed in certain locations of the kitchen toy (e.g., get into the identification zone of the identification sensors). In some embodiments, the electronic appliances may be fixated to a certain spot in the kitchen, thus an integral part of the main unit, while in others it may be reversible and the player may connect and detach the playing item to the kitchen, for example by attaching it to a hotspot. Some non-limiting examples of playing items suitable for the kitchen toy device are: a pot, a frying pan, a stiffing spoon, various type of vegetables and fruits either sliced or as a whole, with the shell or without it, milk box, milk bottle, cheese, slices of cheese, water bottle, fish, meat, spices such as salt, pepper, oregano, pizza mixture, bread, cakes, sugar, tea bag, cookies, chocolate, cacao powder, candies, and any food product and food ingredient available in the market. The playing items may also be: a microwave, blender, toaster, toaster oven, coffee machine, juice machine, electric kettle, cupcake toaster, and any other electrical home appliance toy for the kitchen. The electrical home appliance toys may be integral parts of the kitchen toy or it may be purchased separately as part of an accessory set as demonstrated in the figures. In both cases, the connected kitchen toy device is configured to identify the electrical machine that is positioned on it, and the food items which are placed in it. In some embodiments, the electric machine by itself may further comprise additional independent capabilities to identify ingredients that are inserted into it. It some of these cases, the electrical machine toy preferably comprises another processing unit, which allows it to function as a stand-alone toy, and communicate with the smart device directly. For example, the microwave, the toaster, the coffee machine and the like are all identifiable playing items with further capabilities to identify each item that is inserted into them or positioned on them. In other embodiments, the electrical appliance may be used as a simple identified toy item, which is identified among all other items in a certain area in the kitchen.

As mentioned above, the connected kitchen toy device of the invention may include RFID reader, NFC reader as well as other identifiers mentioned above that allow identification of more than one playing item simultaneously. In such scenarios, the playing experience creates an authentic feeling of a real kitchen to the child, and gives the child a more realistic experience of pretend play.

The dedicated application in the smart device may further include a presentation of the identified accessories and an illustration of the kitchen, and may be used, but not limited to, giving real-time feedback to the player of his actions with the toy and playing items. The software application may further be used for demonstrating recipes to the player, and allowing him/her to follow the recipe's steps in order to get to a certain result. It may further include educational games, providing facts about food ingredients, knowledge about healthy cooking and give challenges to the player to cook different recipes and to identify different ingredients according to their color, vitamins, calories, chemical structure and the like. The software application may further include a creation mode to allow the player to create different recipes with the elements he has in his hands, using different identification areas of the kitchen toy device. It may further allow users to share their creation online, and get new recipes from others. The new recipes can be "played" on the kitchen toy device, thus creating a new way of play with the physical toy.

In some embodiments, the kitchen toy may include, but is not limited to: an identifier in the stove, an identifier in the oven, potentiometers to set the stove and the oven's temperature, LEDs to simulate indication of operating mode, for example, in the oven, in the stove, in the tap, and in the kettle.

The player may put a pot on the stove, the pot is identified by the software application (hereinafter: "app") and the app may show a reflection of the pot being placed on a virtual stove. Then, the user may pour water from a water bottle above the pot and this action will be imaged on the smart device's screen, and the pot in the application will start to fill with water. As long as the water is above the pot, the virtual pot will keep filling, until the water overflows and the user might need to empty the pot and start over. This example demonstrates how the kitchen toy device may use time evaluation in order to enrich the play pattern; the toy may constantly send data to the smart device, updating the app about input, output, and the current state on the kitchen toy device and the playing items in use. Additionally, it demonstrates the ability of the app to analyze a series of actions, and not just a single action, which may result in a different dish each time a player changes his actions. A dish may be burnt if the oven potentiometer was set on a temperature too high, and a soup may become a sauce if the player will not put enough water in the dish. These kind of complex responses make the connected kitchen toy seem "more real", compared to prior art kitchen toys, and as such, simulate a close to reality cooking experience, in which every action results in a different outcome.

The app may further change the appearance of products in their virtual appearance on the smart device, thus helping to enrich the imagination of the child while playing with the connected kitchen toy of the invention, which may further contribute to the genuine experience of the connected kitchen toy device. For example, putting water and a tomato inside the pot and stirring, may change color and become a red tomato soup in the application. A cheese in the oven may change form and melt, and an onion on a frying pan may change its color from white to brown. These changes are not possible in any of the physical toys known in the art, and the combination of the physical toy with the app provides the child an experience of real cooking. This experience may be empowered by combining sounds of cooking like, boiling sounds, frying sound, water flow sound, mechanical sounds to simulate operation of the electrical appliances, operation indicating lights in the electrical toy devices such as oven, kettle, microwave, stove, and the like; and by further using odor sensors that enhance the coking experience. For obtaining these enhancing effects, the kitchen toy may further include other I/O element, such as buttons, LEDs, potentiometer and the like as mentioned in the above and as will be demonstrated with reference to the figures hereinbelow.

In some implementations of the invention, the I/O elements are configured to enhance the child playing experience in different manners. For example, LEDs may be turned on as positioning indicators to indicate where to put the identifiable playing item. Alternatively, they may be used as part of the game, for example, simulating the light inside the oven, the fire on the stove or blue light simulating water in the tap. Buttons may be used for different operations in the kitchen toy, for example to turn on the micro, to open the stove, to open the tap or operate the kettle. The buttons may further be used for identification of an action; for example, they can be implemented inside a toaster, thus will be pushed only when a toast is placed in the toaster, indicating to the app that a toast was placed. Potentiometers may be used for example to reflect the flame intensity of the fire heads on the stove, and further to reflect the intensity of the water flow in the tap and further to set time. LEDS may be used to simulate cold/hot water by changing the color according to a potentiometer position. A speaker may be used for producing kitchen sounds as mentioned above (e.g. frying and cooking noises), a buzzer may be used as part of a timer of the oven or the microwave. All these I/O elements are configured and operable to enrich and enhance the game options and the playing experience with the kitchen toy device.

The smart device may further give challenges to the player, to follow a recipe or to guess the ingredients of a certain dish presented on screen. The dedicated application may further include multi-player games, which allow more than one player to play on the same kitchen and, for example, to compete with each other on time of baking or accuracy of recipe. They can also cooperate to make a three dish dinner, and take positions near the oven and the stove. The players can create recipes and give them as challenges to each other.

The multiplayer social game may also occur through the web, when each of the players is playing with his own physical toy, and the connected toy transfers the data to the dedicated application, which in turn transfers the data to a central server. In this way, each player can make a move on his toy in his own house, and get a response through the web from another player in another place in the world. Thus, the kitchen toy becomes a cooking console, which allows different children to simulate cooking with their physical toys, share ideas and creative thoughts about cooking, and challenge each other in complex recipes.

The subject matter disclosed herein is directed to a connected kitchen toy device configured to allow a player to imitate cooking in a real kitchen, wherein an action performed by said player on said kitchen toy device is identified by and produces a simultaneous reaction on a smart device connected to said kitchen toy and/or on the kitchen toy device, wherein said kitchen toy device comprises at least one input element and one output element, and a communication module for allowing bi-directional communication between said kitchen toy and said smart device. The action performed by the player is identified by at least one input element positioned on said kitchen toy and/or on said smart device, wherein said action results in producing of at least one output reaction on either one of said kitchen toy device, smart device, or on both. Also, the action may be performed by the player on at least one playing item positioned on said kitchen toy device or held in its vicinity, and wherein the action performed by the player and the at least one playing item are both identified and displayed on said smart device and further produce a reaction on either one of the kitchen toy device, the playing item, the smart device, and combinations thereof.

In accordance with the present invention, the playing item comprises at least one identification element configured to allow its recognition by identification means positioned on said kitchen toy device, and wherein upon identification of said playing item, it is displayed on said smart device screen. The playing item may further comprise at least one output element. The playing item and the action performed on/with it by the player may be identified by a camera. In a specific implementation of the invention, the playing item is identified by RFID technology. The playing item may be but are not limited to, home use electrical appliance, vegetables, fruits, milk products, meat products, kitchen tools, eating tools, cooking and baking ingredients and tools, and baking products. The action performed by the player may be a series of actions directed to preparation of a dish or a drink.

Various input elements may be used for implementing the invention including without limitation: buttons, potentiometers, touch sensors, light sensor, color sensors, hall-effect sensors, audio sensors, odor sensors, motion sensors and temperature sensors. Identification of actions and items may be obtained by using identification acceptable technologies consisting such as RFID, NFC, capacitive sensors, hotspots, ultrasonic triangulation based sensors, sensors based on energy harvesting, weight sensors, photo-sensors, color sensors, gated buttons and a camera.

The reaction obtained may be a virtual reaction displayed on said smart device or a physical reaction produced by said kitchen toy device, or both. The reaction may be produced by the output elements and contains at least one of an audio output, a visual output, an odor output, and a mechanical output. The audio output may be for example, a buzzer, a speaker, and a sound produced by the smart device, and said visual output is selected from: a light, a LED, an animation, a picture, an illustration displayed on the smart device or a dedicated screen on said kitchen toy device.

In some embodiment, the connected kitchen toy device comprises at least one of: a toy sink configured to light up at least one LED simulating water flow upon performance of an action by said player, a toy stove with at least one flame head configured to light up at least one LED simulating fire, wherein a virtual sink with a water flow and/or a virtual stove with a flame are simultaneously displayed on said smart device's screen. The water flow intensity and/or the flame intensity are modified according to the position of a sensor set by said player, wherein a virtual illustration reflecting the real-time intensity of said flow/flame intensity is displayed on said smart device. The sensor in use in such embodiment is preferable a potentiometer. The flow/flame intensity may be modified by the player on said smart device and the data is delivered via said communication module to the kitchen toy device to thereby create a corresponding change in real time on said kitchen toy device.

In some embodiments of the invention, at least one output element is configured to be operated by the smart device to perform a physical reaction on said kitchen toy and/or playing item. The output element may either one of but not limited to, buttons, LEDs, potentiometers, piezoelectric sensors, touch sensors, smell sensors, light sensor, buzzer, speaker, microphone, and identification sensors.

The communication module allows simultaneous transmission and receipt of data from some identifiable playing items to the smart device and/or to said kitchen toy device.

The playing item may further comprise hardware and a motion sensor configured to allow identification of movements performed by the player with said playing item. Such playing item may be, without limitation, a cutlery, cooking and stiffing spoons, cooking utensils, and serving utensils.

The smart device comprises dedicated software configured to analyze different states according to data obtained from said input elements, and to output a reaction according to a specific identified state.

The connected kitchen toy device of the invention may be incorporated into a doll house toy. In such embodiment, one of the playing items may be a doll. In an alternative implementation of the invention, a doll house toy may comprise a connected kitchen toy device as described herein.

Reference is now made to the figures:

FIG. 1 is a schematic illustration of an example of a connected kitchen toy device 100 with various identifiable playing items positioned on it and a smart device 180 positioned on the kitchen toy wall 182. Kitchen toy device 100 comprises a toy stove 110 with four flame heads 112 each connected to an On/Off button 114. The stove area may comprise identifiable means that allows identification of playing items positioned on the stove. Additionally or alternatively, the identification of the playing items in use may be obtained by using the smart device camera and/or another camera positioned in the kitchen toy device 100. Each On/Off button may comprise a potentiometer configured to allow identification of the flame head that is in use, and a proper reaction to the player's action. For example, upon rotating the button to the right side, LEDs positioned in the appropriate flame head 112 may light up and the intensity may be change according to the button position (high flame/low flame). This data may further be transmitted to the smart device to allow display of a virtual similar stove and the relevant flame head that was turned on, and a flame in a size matching to the intensity that was chosen by the player (high flame/low flame). Monitoring the actions performed by the player on the physical toy further allows the app to instruct the player, for example, to put a pot 127 on the fire, to change the flame head that was lit to another, to increase the flame high or decrease it, to be careful not to be burn, and the like. The game may have additive value and may teach the child for example, to identify directions (left, right, front, back), to improve the player's motor coordination using the correct button for the desired flame head, and to perform various movements for example pressing a button, rotating it to the right, rotating it to the left, pulling a handle upward, pulling a handle downward to allow the child to explore various possibilities and encourage creative thinking while approaching things. Kitchen toy device 100 preferable comprises a sink 120 having a tap 122 and a handle 121, and a drain hole 124. Sink 120 may contain means for identifying playing items positioned within it and actions that the player may perform such as, to open/close the tap, to insert a tool into it or take it out after washing, to wash hands, to wash vegetables and fruits before eating and cooking, and the like. The identification may be performed by various input elements such as sensors as mentioned above, or by using image recognition, for example by a camera. Other options for playing with the toy sink 120 will be described in details with reference to FIGS. 4A-4B. A drying surface 123 may be positioned adjacent to sink 120 for putting washed instruments such as bowl 128 and spoon 129 to be dried after washing. Kitchen toy device 100 may also comprise an oven 130 having a handle 133 to open the oven's door 136, an operation switch 134, and a display area 132 that may display, for example, the time (clock), the temperature, and a timer counting. The door may comprise a sensor configured to indicate the opening and closing of the oven such as a Hall-effect sensor (described in details with reference to FIG. 6). Operation switch 134 may provide indication of operation by actuating a LED to light up upon switching it to the right/left or pressing on it. In a further variation, the oven may contain internal LEDs simulating operation mode. In a further example, internal LEDs may be placed to imitate bottom and upper grill operation, wherein the LEDs are configured to be turned on and off according to the position of the operation switch (the switch may comprise a potentiometer, or it may toggle different states of the oven toy). Oven toy 130 may further comprise input elements such as identifying means that allows recognition of other playing items that the player may insert into the oven. The actions performed by the player are further transmitted to the smart device that may display a virtual image of the physical toy in a specific time point, and further provide inputs and outputs that are suitable for the identified situation of the physical toy device as will be described in details below.

Kitchen toy device 100 may further comprise a storage station 140 containing, for example, two storage shelves 142 and storage cabinet 144, for placing ingredients, plates, glasses, and cooking tools. In the specific example illustrated in this figure, a pile of plates 142*a* and small bowls 142*b* are placed on one shelf, while the other shelf 142 contains a basket with lemons 142D and a basket with onions 142C. Storage cabinet 144 preferable comprises a handle 143 that allows the player to open the cabinet door. The door may be attached to a sensor such as Hall-effect sensor to provide indication to the app installed on the smart device that the door was opened. In a similar manner to the oven, the cabinet 144 may comprise various sensors that may sense and indicate the presence of playing items that the player may insert into cabinet 144, that may further allow the smart device to refer to it in real time, and instruct the player to take an ingredient he needs for preparing a certain recipe from the cabinet. In the example illustrated in this figure, kitchen toy 100 comprises a sitting area 150. The sitting area may also serve as serving area for putting dishes that the player has made. Near the sitting area, at least one chair 156 may be placed to allow the player to sit with a friend or a doll and imitate eating and drinking. Chair 156 may be an identifiable item that may be recognized by the smart device when it is placed near the kitchen toy device, or it may be a regular chair that the player has in the house. In the first option, the chair may further comprise a pressure sensor that recognizes when sitting on it. Such data may be transmitted to the smart device that can turn to the player and interact with him/her. In the specific example illustrated in FIG. 1, a big plate with cookies 154, two personal plates with cookies 1541, two cups of tea 152, and a spoon 129 are placed on top of the sitting area 150. Two chairs 156 are placed near this area, one chair having a doll 159 sitting on it while the other is empty. Serving surface 150 may be designed in different shapes and heights, for example as a counter of a bar or an extended table. The child may sit with a friend, a family member or a favorite doll and imitate a social event of sitting in a restaurant, a coffee shop or a dining table at home and play eating and drinking scenes after of while cooking.

Kitchen toy device 100 may further comprise a working surface 160 with a towel 145 hung on the side of the working surface, and optionally, one or more electrical appliances such as a toaster 172, a kettle 174, and a mixer 176. Other electrical toy devices simulating devices that are usually used in a real kitchen such as microwave, refrigerator, coffee machine, ice cream maker, bread baker, blender, and the like may also be used with the present invention and included in the scope of the present invention. Towel 145 may be hung on the kitchen surface in various places and by various means including, without limitation, magnets, Velcro and hooks. In the example illustrated in FIG. 1, above stove 110 the kitchen toy device 100 comprises a wall 182 with a dedicated place to position a smart device 180 and an extractor hood area 184 with hooks 185 around it for hanging cooking tools 188, such as a stiffing spoon, slotted spoon, frying spoon and ladle (described in details with reference to FIG. 2E).

Figure 3F:
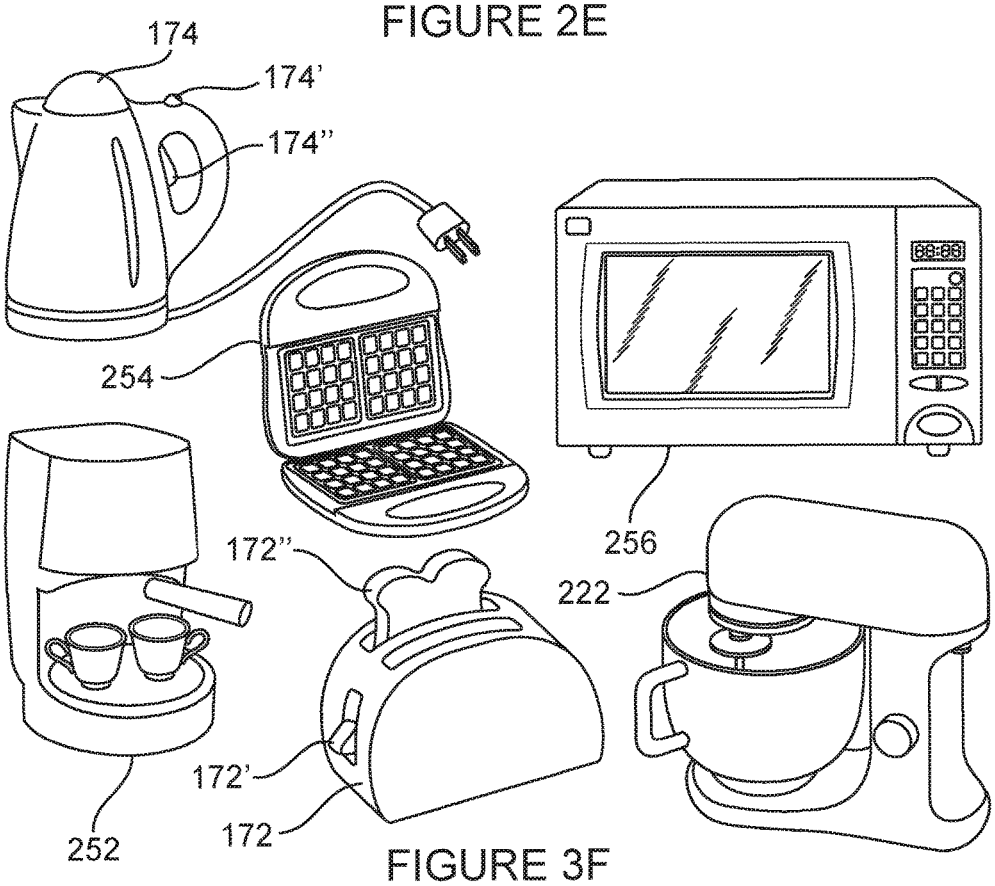
FIG. 3A is schematic example of optional layers composing a stove unit in a connected kitchen toy, wherein first layer illustrates the top layer with the plastic and output elements; second layer illustrates sensors and antennas; and third layer illustrates optional hardware, in accordance with embodiments of the invention.
FIG. 3B illustrates another optional hardware for different implementation of the stove unit.

Each of the above mentioned areas may include various types of sensors as mentioned above and identification means, and thus when playing items are placed in these areas, they are recognized and may appear on the smart device's screen. A detailed description of the inner structural components of the connected kitchen toy device of the invention is provided with reference to FIG. 3 below.

The application game on the smart device 180 may direct the player to move from one area to another, for example, to wash vegetables in the sink and then to put the vegetables in a baking dish and to cook them in the oven or to put them in a pot with water and to cook them on the stove. The game may further instruct the player to operate more than one area simultaneously according to the playing level and the child age, for example, to bake the pie base in the oven, while preparing the vegetable stuffing on the stove, thus creating a more complex dish and new challenges to the player.

Each area of kitchen toy device 100 may contain I/O elements, such as but not limited to, buttons, sensors, LEDs, speaker and buzzer as mentioned above and will be described with reference to some of the other figures. All of these may further be connected to the smart device and may be activated by the smart device or by the player according to the type of the I/O element in use.

The I/O components may contribute to the activity in a specific area of the kitchen toy device 100, or to the activity on the kitchen toy as a whole. Kitchen toy device 100 may further include a weight sensor to allow the user to weigh the ingredients as in a real kitchen (not shown). Alternatively, the weight sensor may be implemented as a toy weight appliance to be used as additional identifiable playing item.

A further play pattern with kitchen toy device 100 may include recording of new invented recipes and sharing it with friends and parents. The child may record himself through the smart device, or by pressing a physical button on kitchen toy device 100 (not shown). The child's voice, as well as his activity with the playing items in the kitchen toy device, may be documented and recorded into a video, for example, if the child puts a toast in the toaster while saying: "let's make toasts for my soup", then the app records his actions and the matching animation, i.e. a toast being inserted into the toaster and getting browner, along with his voice are recorded. Thus, the player may create a recorded video of his actions while preparing the dish. The video may be saved on the smart device, and further may be shared with friends. This play pattern can also be used as a way to remember how specific dishes were made, and optionally to create a library of cooking videos of the child, similar to popular television cooking shows, where the child is the star of the show. Children may further send recipe challenges to each other, after creating new complicated dishes, challenging other users to prepare them in a certain amount of steps and to a certain degree of accuracy. They can also time their achievements, asking other players to break their record and make the dishes faster.

Figure 2A:
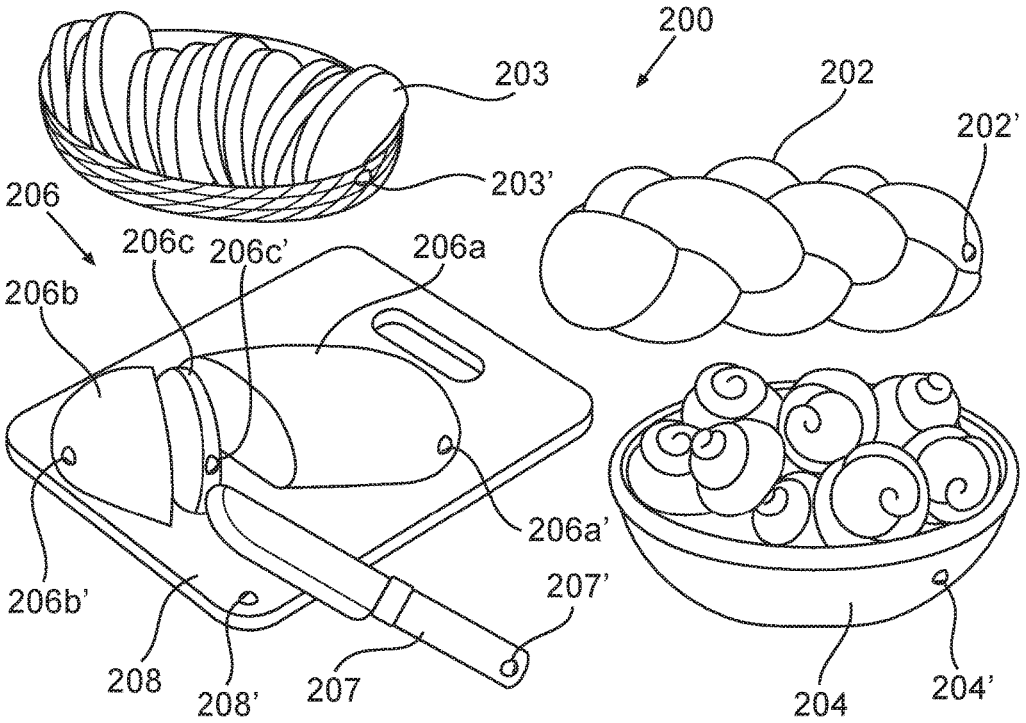

FIGS. 2A-2H are schematic illustrations of some examples of sets of identifiable playing items for playing with the connected kitchen toy device 100 illustrated in FIG. 1. FIG. 2A illustrates an example of breads set 200 comprising a loaf of bread 202 comprising identification tag 202', which can be placed inside or on the surface of the bread, a basket with sliced bread 203 with identification tag 203', 3 pieces sliced bread 206 having pieces 206*a* with identifying tag 206*a'*, piece 206*b* with identifying tag 206*b'*, and piece 206*c* with identifying tag 206*c'*, which can be connected to each other by mechanical means such as magnet, magnetic color, Velcro and the like (not shown), a bowl with bread rolls 204 comprising identification tag 204', a cutting board 208 with is specific identification tag 208' and a knife 207 with its unique tag 207'. Knife 207 can be used to separate the mechanical connection component attaching the pieces, and may further contain a motion sensor to allow recognition of movements performed by the player with the knife. The identification tags are used to identify the cooking items by kitchen toy device 100. Thus, when knife 207 and bread 206*a*, 206*b*, and 206*c* are placed on the working surface 160, the player's intention to cut the bread is identified and a suitable reaction is performed by the smart device. Such a playing set may allow the player to prepare sandwiches or to slice bread pieces to eat with a soup, or to prepare a bruschetta, or to put in a basket as part of a breakfast meal that the child prepares. The tags attached to the playing items may be 'off the shelf' tags of any identification technology available in the market including without limitation: RFID tags, NFC tags, tags for hotspots, barcodes and the like.

For simplifying the description, in the following description of the sets of identifiable playing items, the tags are not shown.

Figure 2B:
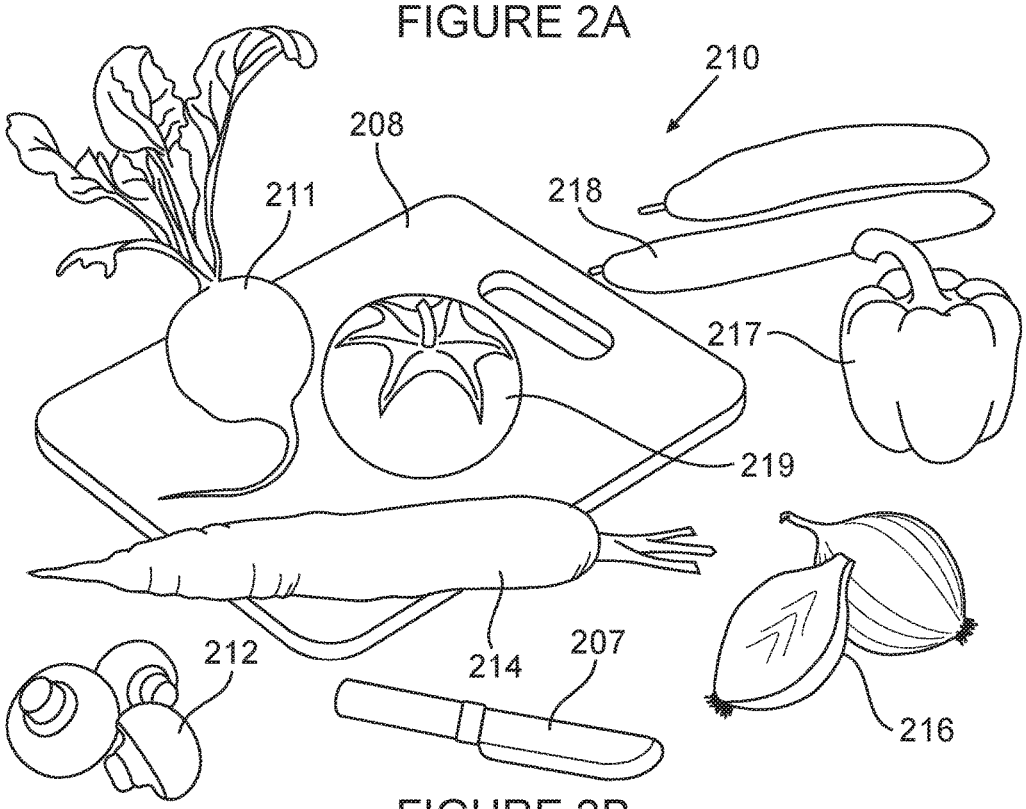
Figure 2C:
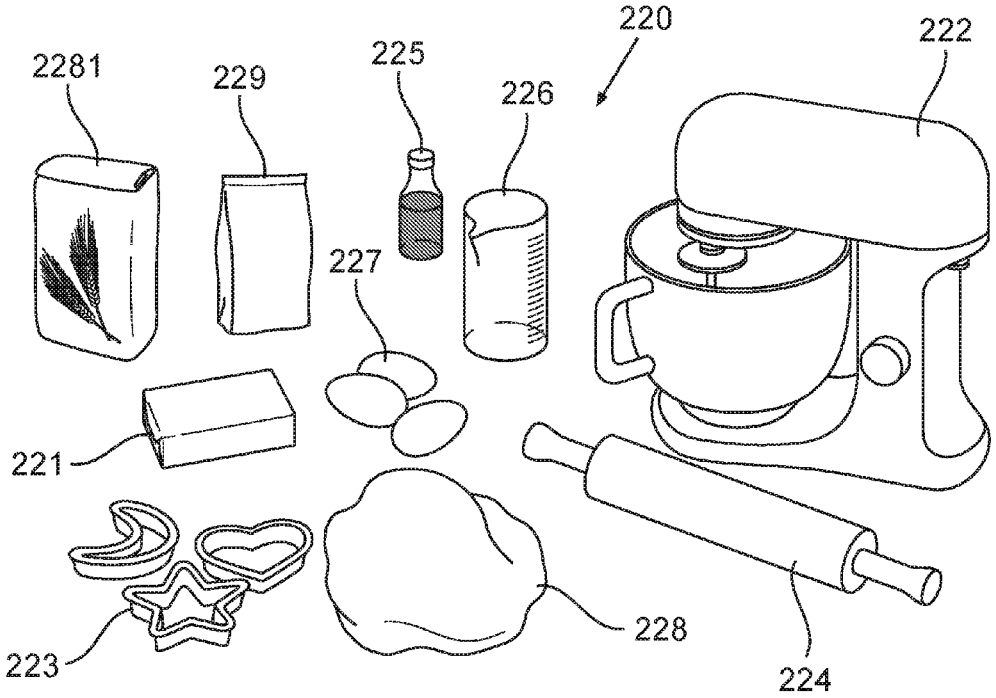
Figure 2D:
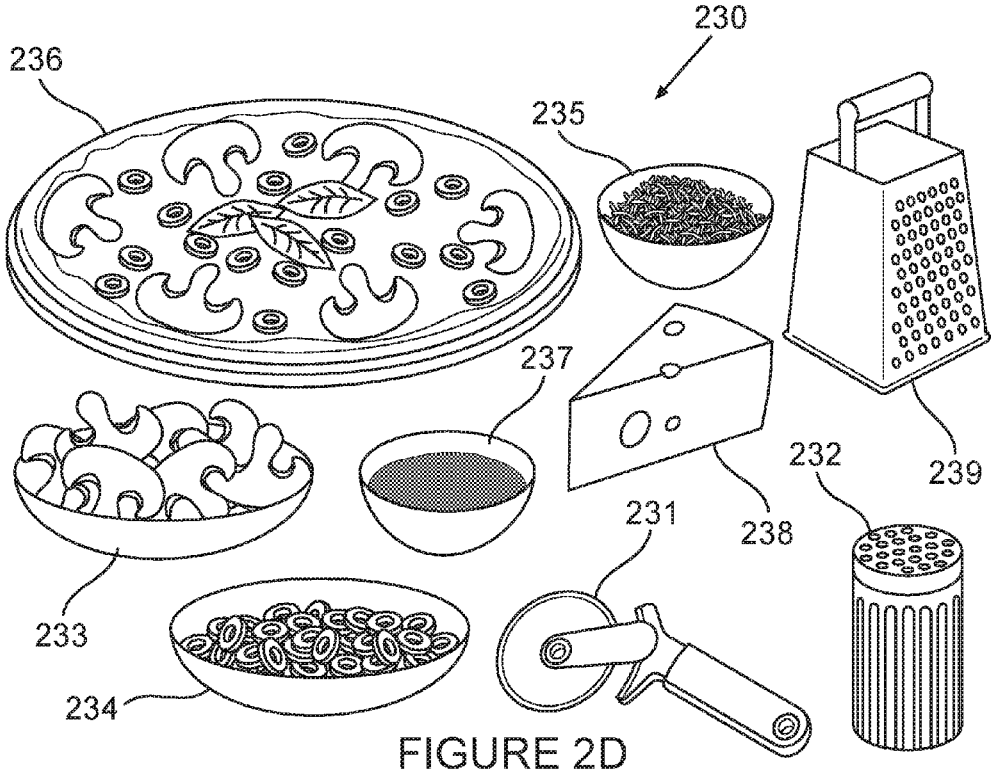

FIG. 2B illustrates various vegetable set 210 with a cutting board 208 and a knife 207. This set of playing items may further include, for example, radish 211, mushrooms 212, carrot 214, onions 216, pepper 217, cucumbers 218, and tomato 219. The child can pretend to be slicing the vegetables for preparing a salad, a vegetable soup and other dishes with vegetables, or just prepare slices of vegetables as snacks. Alternatively, each vegetable may be sliced into predefined pieces to further teach the child counting pieces of a whole (i.e. half, quarter, fifth and so on). Each of the identified play items may be displayed on the smart device that may provide the player with the name of the item, the season it grows in, the geographical area that it originated from, the prominent vitamins that it contains, various dishes that may be made from it and many other interactive options according to the difficulty level of the game and the age of the player. FIG. 2C illustrates an example of connected baking set 220 with some baking instruments and ingredients. The baking set 220 in this example comprises a mixer 222, a rolling pin 224, a measuring cup 226, dough 228, flour 2281, dough cutters 223, butter 221, eggs 227, vanilla extract bottle 225, and cocoa powder 229. It should be clear that the above list of ingredients and baking tools are only an example and other tools and ingredients and tools for preparing pasta, pizza, cupcakes, muffins and other types of baking products and materials are within the scope of this invention. FIG. 2D is an illustration of a pizza preparing set 230 and accompanying accessories such as pizza cutter 231, and a seasoning shaker 232 for pizza such as oregano and garlic mix, a plate with slices of mushrooms 233, a plate with olive rings 234, a plate with some shredded cheese 235, a wooden board with a pizza 236, a bowl with tomato sauce 237, a block of hard cheese 238, and a grater 239.

Figure 2E:
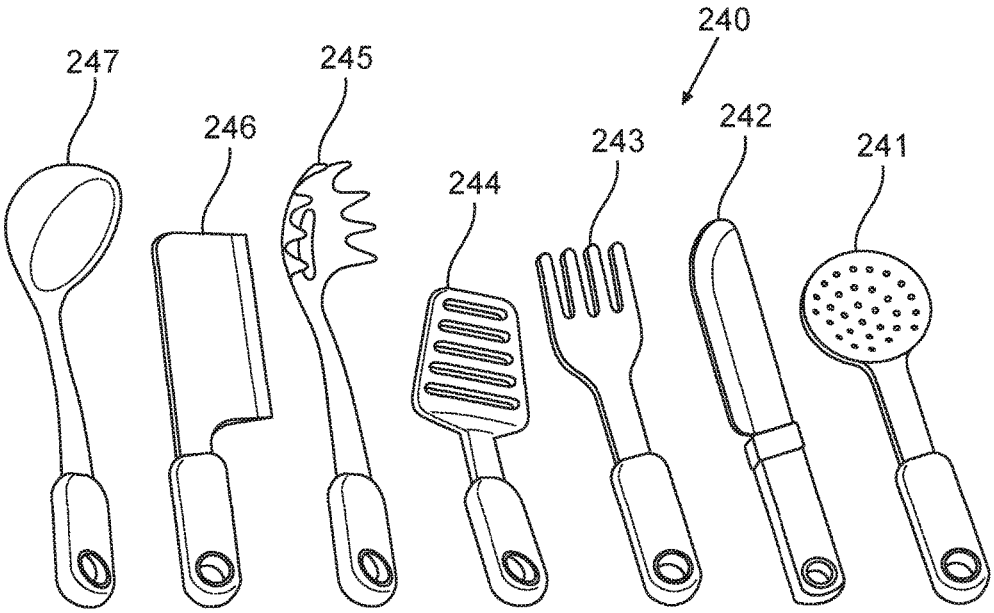

The child, for example, that wants to make a pizza may prepare one with the ingredients of the pizza set. The child may take the toy pizza and put it in the toy oven. The pizza is recognized by at least one identification component placed inside the oven as mentioned above. The dedicated app may then present the unbaked pizza getting browner and browner in the oven, and may show a timer for the optimal baking time. A similar time may be displayed on the toy oven display. The child may further use a potentiometer on the control panel above the oven, to set the temperature according to instructions he receives from the app and the temperature value may be displayed on the smart device's screen or on the oven display area, or on both. When the player closes the oven's door, a LED inside the oven may light up, and the smart device may shut the light on the screen off when the time is over to teach the child that it is time to take the pizza out of the oven. Additionally or alternatively, LEDs inside the oven may be turned on to imitate operation mode of the oven. Additionally or alternatively, when the time is over, a sound of a ringing bell may be produced, for example, the smart device may send instructions to a speaker positioned on kitchen toy 100 when the time is over. Optionally, a voice from the smart device may further be heard saying, for example, "Your pizza is ready". In some embodiments of the invention, a button located on the side of the oven may become mechanically pressed by the oven's door when is the door is being closed, thus once the player opens the oven to take out the pizza, the app may get a signal that the button was released. FIG. 2E illustrates a connected set of tools 240 for the kitchen toy 100 that comprises a separate processing unit with a motion sensor configured to allow recognition of the movement the child makes with the tool in real time. Optional tools for such purpose are slotted spoon 241, knife 242, fork 243, frying spoons 244, 245, chopper 246, and ladle 247. For example, the motion sensor can be used to identify stiffing movement and cutting movement. These tools may also connect independently to the smart device. It should be clear that the above list is only a non-limiting example and other tools may also be used for the same purpose. FIG. 2F is a schematic illustration of some identifiable play items designed as home-use electrical appliances for the kitchen toy device 100. The electrical appliances may be an integral part of the kitchen toy device 100 or separated therefrom. Some optional examples shown in this figure are kettle 174, toaster 172, mixer 222, coffee machine 252, waffles toaster 254, and a microwave 256. These playing items, besides for being identifiable by themselves, may further comprise various I/O elements that allow recognition and simulation of other items inserted into them and imitation of their operation mode. For example, the mixer may comprise mechanical elements that functionally rotate the relevant parts to simulate mixing movements for preparation of a cake, a button to push for operating and shutting off the mixer, LEDs to indicate that it is in an "ON" mode, and a speaker that produces electric motor noise when it is simulating operation mode of the toy. The electric kettle 174 may comprise On/Off button 174" and a LED 174' that turns on upon "operation" of the kettle toy. In the same manner, toaster 172 may comprise a button 172' that upon pressing on it, a toy toast 172" is inserted into the toaster and after a predefined period of time, it automatically jumps out as in the real toaster. The toaster may further comprise a gated button inside the bread slot, which can only be pressed by the bread being placed correctly in the slot. Thus, it may allow a simple identification of the toast being placed or removed from the toaster.

Figure 2G:
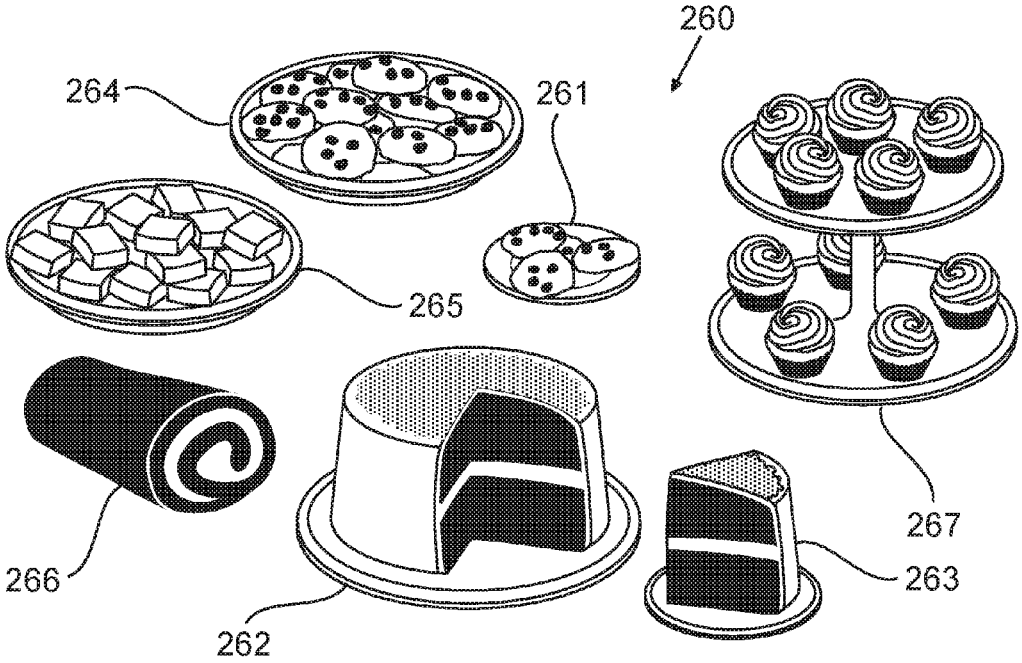

FIG. 2G is a schematic illustration of a set of pastries 260 including a sliced cream cake 262, a small dish with one slice of the cream cake 263, a large plate with chocolate chip cookies 264, and a small plate with few cookies 261, a plate with pieces of brownies 265, a rolled cake 266, and cupcakes 267.

Figure 2H:
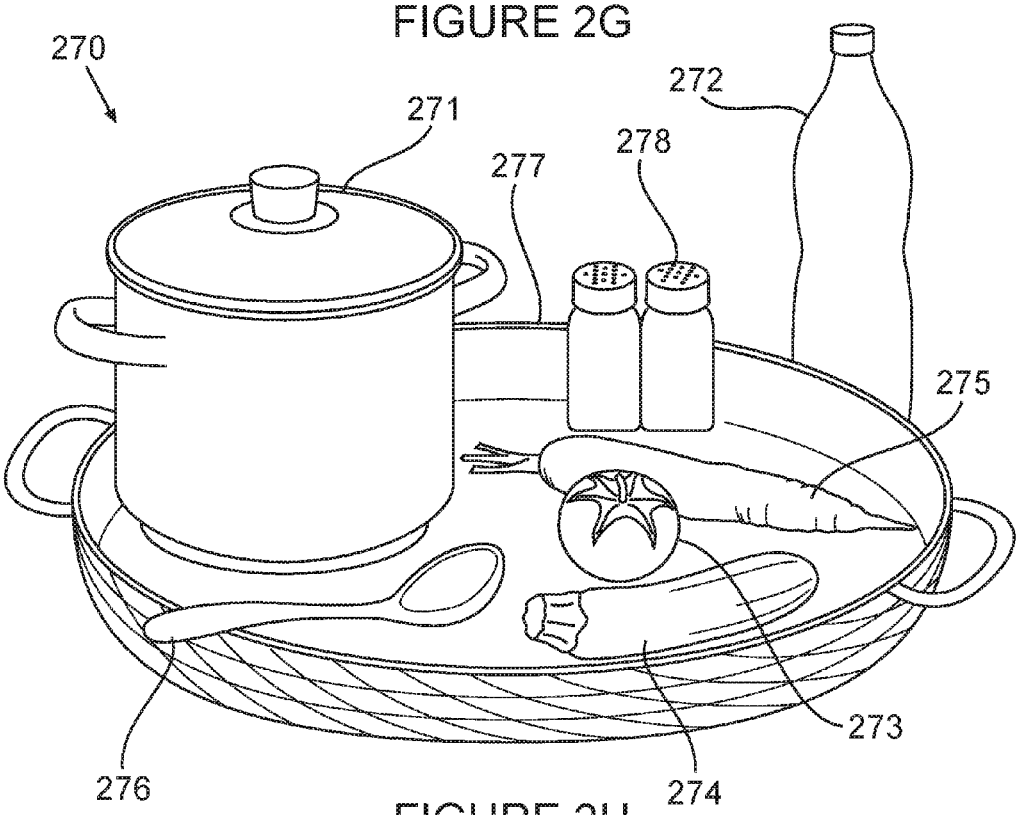

FIG. 2H is a schematic illustration of a kit 270 for preparing a vegetables soup arranged in a basket. In the specific example illustrated in this figure, the kit comprises a soup pot 271, a water bottle 272, tomato 273, zucchini 274, carrot 275, and a stiffing spoon 276, salt & pepper 278, and a basket 277. The child may first put the pot 270 on the stove and the app on the smart device will recognize this action and the stove with the pot will be displayed on the screen of the smart device. In addition, the app may communicate with the child and say "Let's prepare a vegetable soup" according to the specific identification tag on the soup pot 271. In the next step, for example, the app may instruct the child to pour water from the bottle 272 into pot 271. Upon doing so, the virtual pot displayed on the screen will be filled with water and the app may interact with the child and instruct him to keep filling the pot if more water is required (the time duration that the child holds the bottle on top of the pot may be used as indication of the amount of water that is poured into the pot). Alternatively, if the duration is too long, the water on the screen may be viewed as overflowing out of the pot, and the child may be requested by the app to start over or to position the pot above the sink and empty it a bit. In the next step, the app may instruct the child to insert the vegetables and to stir the water with the vegetables, to add salt and pepper 278, and the like. The kit may also comprise other ingredients and components such as, but not limited to, a ladle and soup bowls, so as to allow the child to pour the prepared soup in the bowls and serve it to his mom, a friend, a doll or to eat it by himself.

As illustrated above with reference to FIGS. 2A to 2H, the identifiable playing items are variable and may include, without limitation; cooking tools, such as pots, pans, baking pans, stiffing spoons, cooking forks, plates, cutlery, glasses, plates, bowls, cutting boards, serving boards, food ingredients, vegetables, fruits, milk products, meat products, and electrical home-use appliances for preparing and cooking food. The playing items may be recognized by an identification component positioned and implemented within kitchen toy device 100. Each playing item comprises a unique tag that allows the identification of the specific toy item. For example, when a pot is placed on the stove, the identification unit in the stove identifies the pot and sends the data to the smart device that a pot was placed on the stove. Alternatively, gross data is transferred to the smart device that analyses the data received and indicates that a pot is now positioned on the stove. In addition, identification may be performed by a camera of the smart device or a dedicated camera. The dedicated software app installed on the smart device may further display the pot on the stove, and ask the player to stir the dish. The stiffing spoon may further include a motion sensing component, such as accelerometer and a gyro, which identifies the stiffing movements made by the player. Motion sensing unit may also be inserted in other accessories or ingredients, such as salt and pepper containers, a pan, a kettle and the like.

Figure 3A:
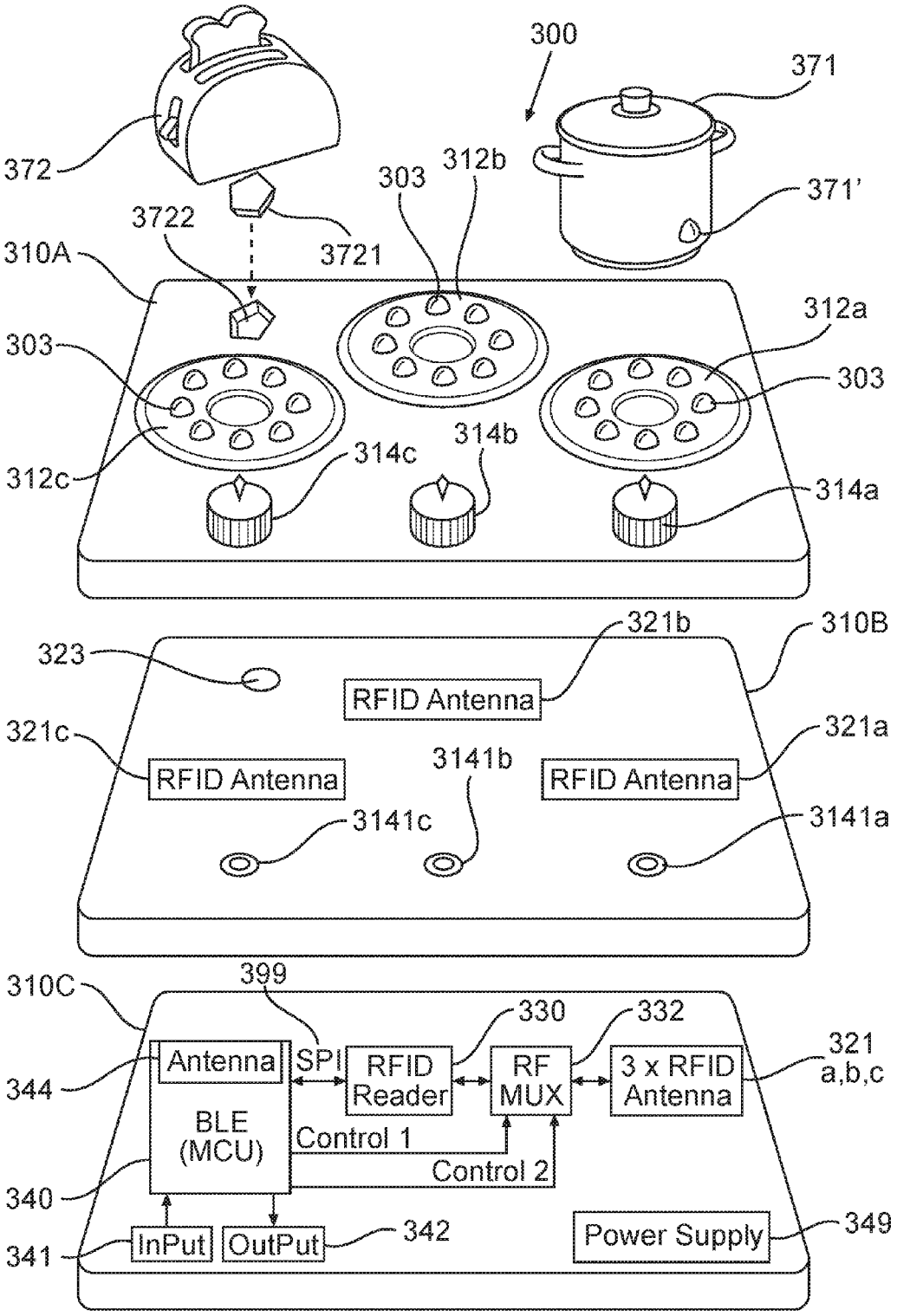
Figure 3B:
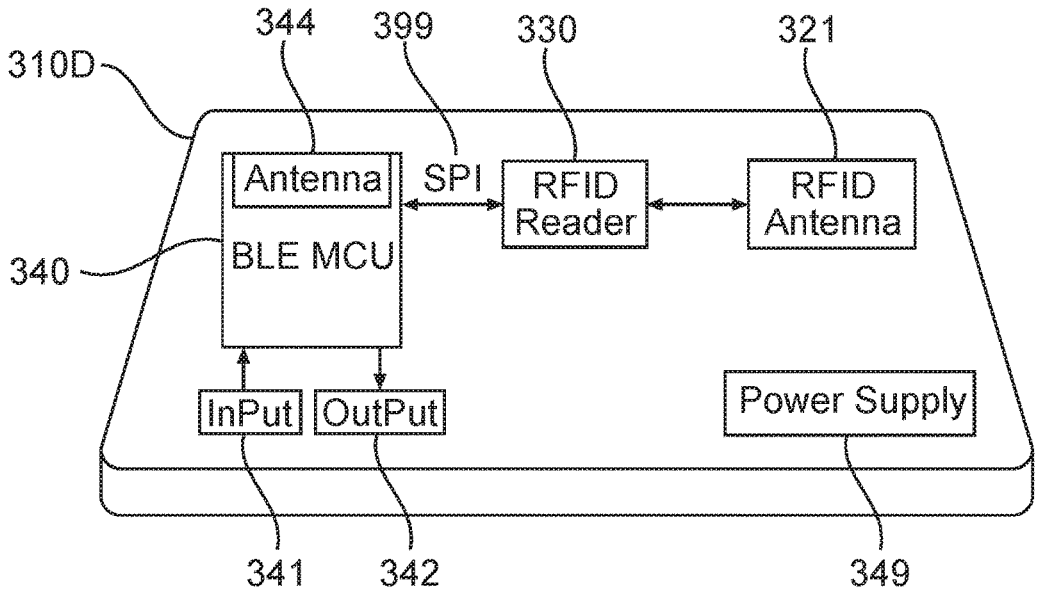

FIG. 3A illustrates a schematic example of optional layers composing a stove unit in a connected kitchen toy and their connection pattern with toy pot 371 comprising RFID tag 371' and toy toaster 372 having a gated button 3721 shaped as a pentagon (male) attached to its bottom surface and configured to fit with a complementary gated button (female) 3722 embedded on upper layer 310A of stove 300. The uppermost layer 310A is generally composed of the decorative elements that provide the toy the shape and character of a stove and preferably, but not necessarily, made of plastic materials or wood, and may further comprise input elements and output elements. In the specific example illustrated herein, stove 300 comprises three flame heads 312*a*, 312*b*, and 312*c* each having at least one LED 303. Each flame head is functionally connected to a respective operation button such as a potentiometer, the upper covers of these buttons 314*a*, 314*b*, and 314*c* being positioned in upper layer 310A. Second layer 310B is a middle layer configured to connect between the upper layer and the bottom layer that comprises the hardware. Middle layer 310B may contain elements and parts thereof of various input and output elements. In the specific example illustrated in FIG. 3, middle layer comprises a bottom side of the gated button 323, the potentiometer sensors 3141*a*, 3141*b*, and 3141*c* respective to the covers on the upper layer, and three RFID antennas 321*a*, 321*b*, and 321*c*, wherein each is positioned below a respective flame head to allow identification of playing items positioned on the specific flame head. The third layer illustrates optional hardware, in accordance with embodiments of the invention. The basic electronic solution presented in this figure is based on two main components: Bluetooth Low Energy (BLE) 340 (comprising a MCU), and RFID Reader 330. The BLE 340 controls the communication with the smart device using the RF communication antenna 344, receives information from the RFID antennas 321*a*, 321*b* and 321*c* about tags close to the RFID antennas, and sends and receives information from/to the peripherals devices by input sensors 341, and output sensors 342. BLE 340 is connected to the RFID reader 330 by a standard Serial Peripheral Interface (SPI) 399, and to the RF MUX 332 by standard output on the PCB denoted as control 1 and control 2. Power supply 349 gives the necessary voltage and current to the circuit. The input sensors 341 may include, for example, potentiometers 3141*a*, 3141*b*, and 3141*c* that identify rotation and can send the message on the angle of the rotation to the smart device via the BLE 340, which in turn may present a virtual high/low flame according to the extent of rotation. The smart device may further send an instruction to the BLE 340 to operate matching LED 303 via the output channel 342, in order to indicate that the flame was turned on. The RFID Reader 330 reads RFID tags such as 371' placed on/in the toy items such as pot 371, and passes the information to the BLE 340 via the relevant RFID antenna 321. In this example, as three antennas 321*a*, 321*b*, and 321*c* may be used, the RF MUX 332 is added to the circuit to allow an identification of the antenna that is in use. FIG. 3B illustrates another optional hardware for different implementation of the stove unit having a single flame head. In this embodiment, the electrical circuit comprises only one RFID antenna 321 which is suitable to a toy stove having a single flame head (not shown). In such a scenario, the data is sent automatically to the RFID Reader 330.

Figure 4A:
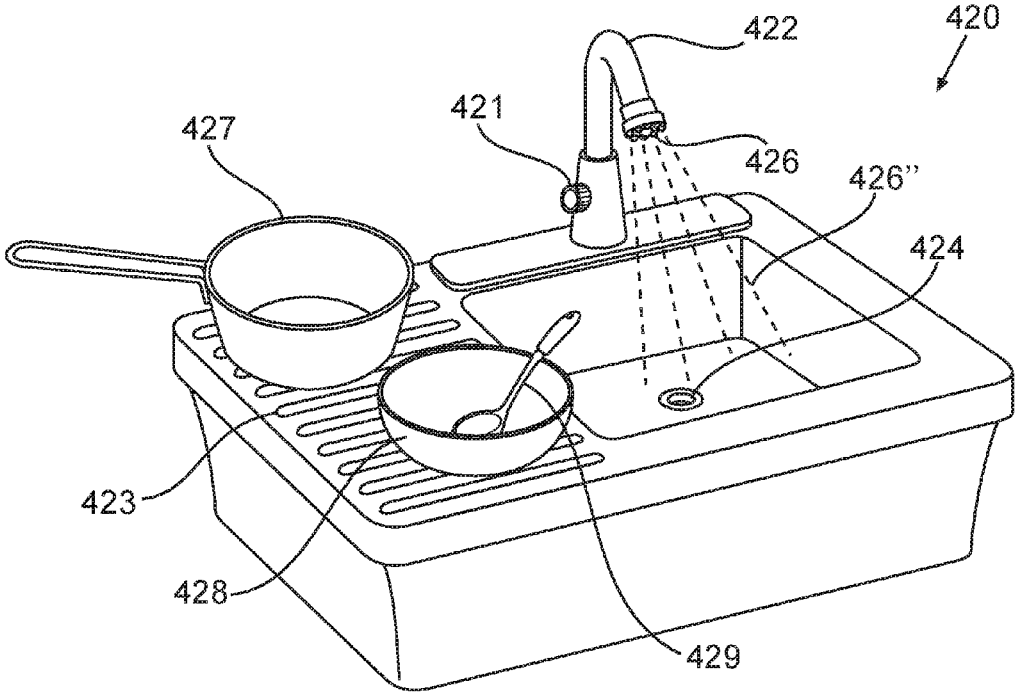
FIGS. 4A-4B are schematic close up views of a connected sink simulating water flow effects (FIG. 4A); and imaging of the connected sink on a smart device (FIG. 4B)
Figure 4B:
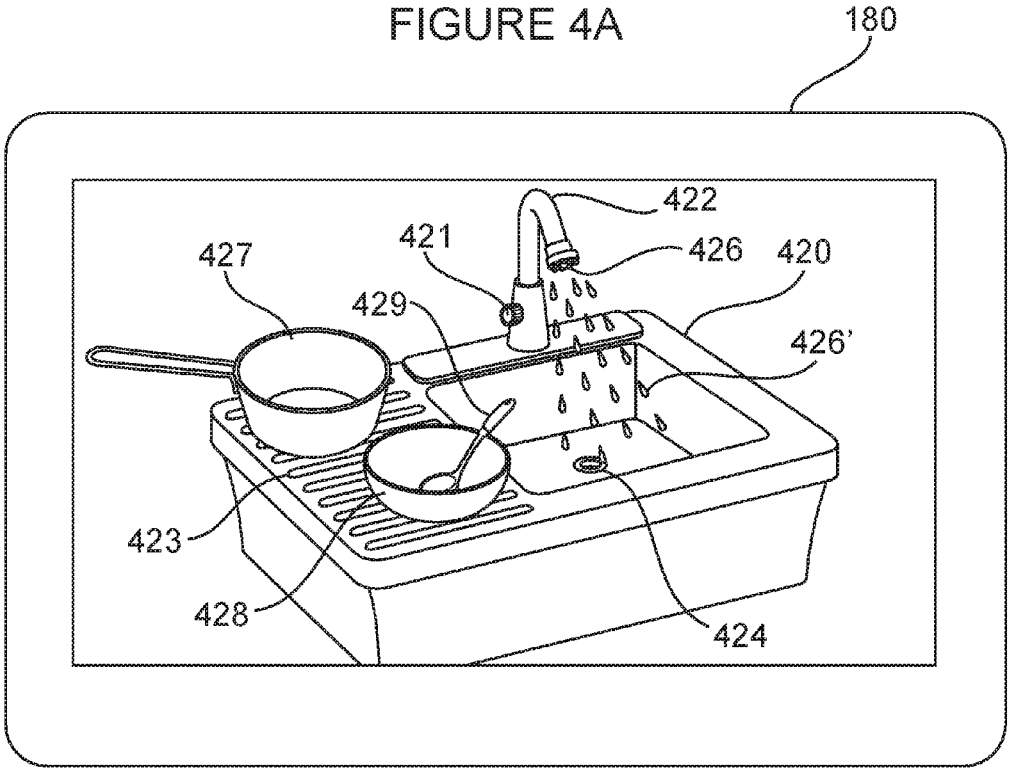

FIGS. 4A-4B are schematic isometric view of a connected sink 420 with tap 422 having LEDs 426 for creating (simulating) water flow effects (FIG. 4A), and displaying the connected sink 420 on a smart device 180 (FIG. 4B). Sink 420 preferably comprises identification means configured to recognize the tools inserted into the sink for washing. The identification means may be positioned in the inner side of sink 420 as demonstrated in FIG. 3 with reference to the stove, and may include various types of sensors, an RFID antenna and reader, NFC antenna and reader, color sensors, QR and barcodes, and other acceptable I/O elements. Optionally, a sensor positioned in the tap recognizes movement below the tap in a manner such that upon positioning of the player's hands below the tap, blue color LEDs 426 turn on to imitate water flow. Alternatively, sink 420 may further contain a button 421 that upon pressing it, the child may open/close the tap to control the water flow in the app and optionally in the physical toy a ray of light 426" will be turned on/off according to the action performed by the player. In accordance with further options, the operation button 421 of tap 422 may comprise a potentiometer and upon rotating it to the right/left the child may control the water flow and the light intensity changes accordingly, to imitate real tap operation mode. The actions made by the player are reflected in the app and drops of water 426' simulating the water flow may be visualized on the screen of the smart device 180. In the specific example illustrated in this figure, sink 420 further comprises at one of its sides a surface 423 for placing washed dishes to dry or dirty dishes before washing, for example, a cauldron 427, a bowl 428 and a spoon 429. Sink 420 further comprises a drain hole 424, that the child may close with a suitable cork (not shown) and the sink in the app will be filled with water.

Figure 5A:
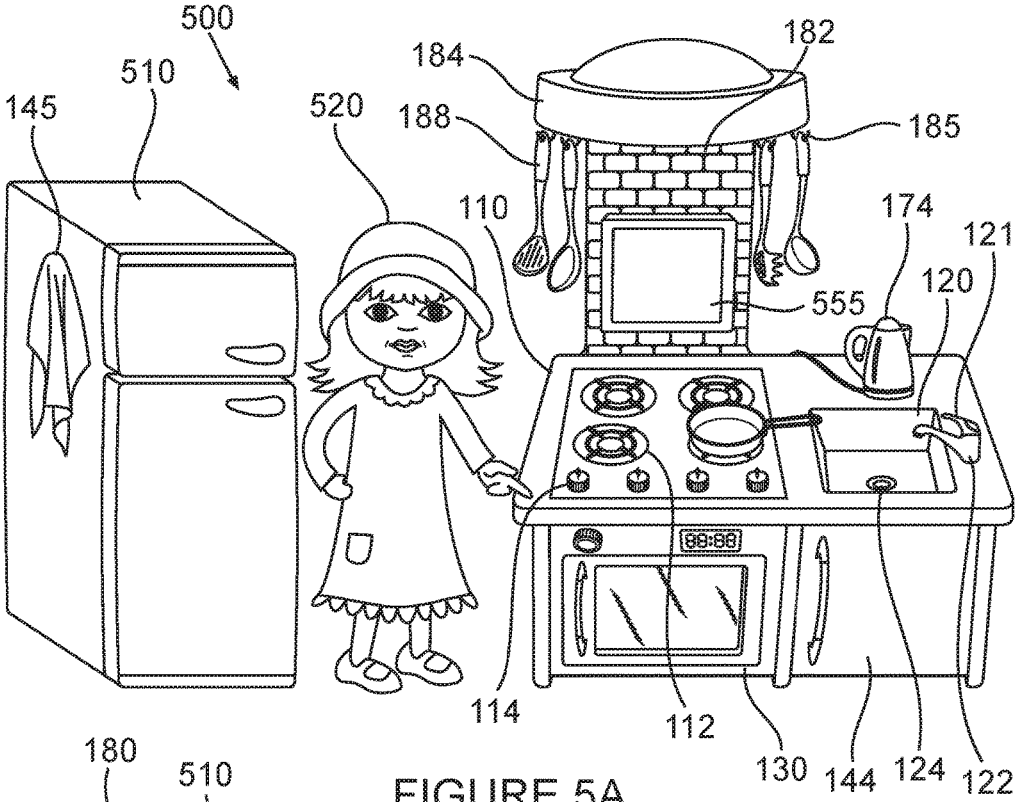
Figure 5B:
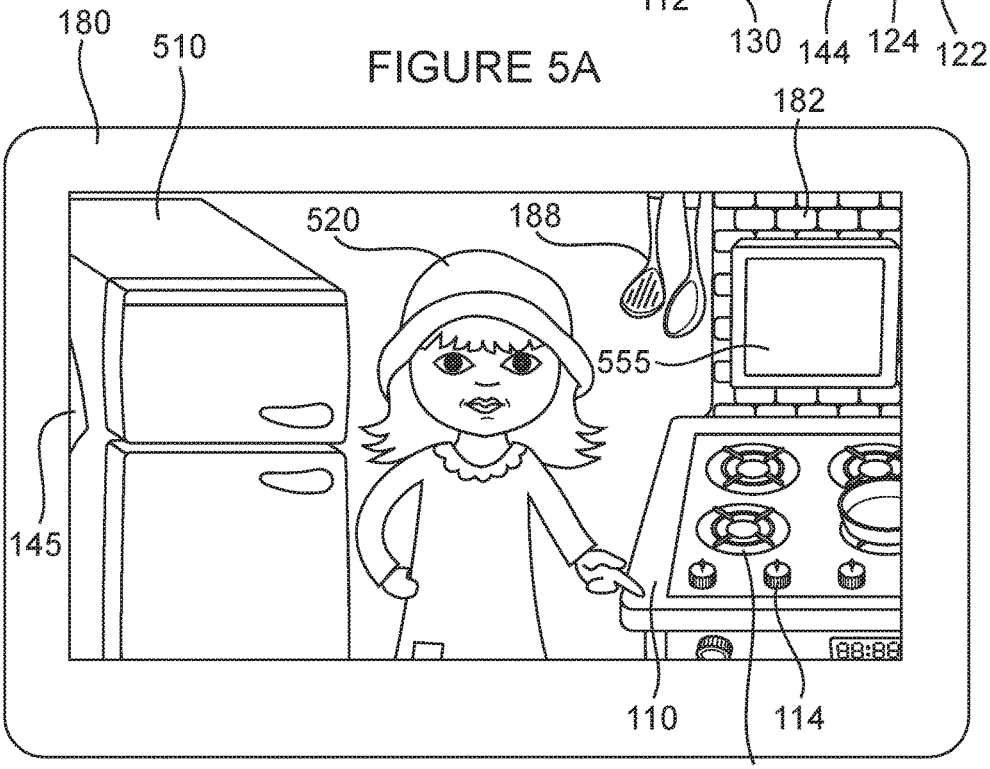

FIGS. 5A-5B depict a miniature connected kitchen toy for dolls 500 and an identifiable doll 520, wherein FIG. 5A illustrates the connected kitchen toy and the doll, and FIG. 5B illustrates a smart device 180 displaying the doll 520 standing in the kitchen toy for dolls 500. The size of the kitchen toy for doll 500 is preferable adjusted to the size of doll 520. In this variation, doll 520 may serve as an identified playing item, among other identifiable cooking products and instruments. Thus, once the doll gets close to a specific identified area in the kitchen, the toy identifies the doll and sends a corresponding feedback to the smart device. For example, when doll 520 is placed near the stove area 110, the smart device 180 may present the doll standing near the stove. This embodiment may further be used with different dolls having different visual appearance and characters, wherein each specific doll is preferably identified by the kitchen toy device. Doll 520 may further comprise its own processing unit, and I/O elements that provide the doll alleged abilities to talk, to sense (i.e. to identify) different toy items, and further to perform mechanical movements by mechanical elements embedded within it. Doll 520 may further comprise a MCU and communication means and may connect to the smart device and the kitchen toy 500 that also comprises various I/O elements, a MCU and communication means. In another variation, the kitchen toy may not include a MCU, and be used as a peripheral item of the doll 520. It this embodiment, an RFID reader may be placed on doll 520, and the kitchen toy will include a plurality of RFID tags, so as to allow doll 520 to recognize its position in the kitchen. Other cooking items may also include RFID tags, to further allow doll 520 to identify them. In such embodiments, it would be possible to determine that the doll is holding a stiffing spoon and standing near the stove and the pot.

The kitchen toy for doll 500 may be a part of a connected doll house (not shown) that is functionally structured and operated in a similar concept as the connected toy kitchen of the invention with the relevant changes. For example, the doll house may simulate an apartment with a kitchen, a bedroom, and a walk-in closet, while all rooms comprises sensors and I/O elements. The playing items in each room are different according to the nature of the room, and the dedicated app is further capable of recognizing the specific room that the doll is located in a certain time point. The bedroom may contain, for example, a dressing table with identifiable makeup articles such as lipsticks in various colors, eye shadows, blush, eyeliner and the like and the actions and movements made by the player may be displayed and recorded by the smart device. The child may learn to stretch accurate lines, to adjust between different colors and to make decisions. In the walk-in closet, the child may learn to dress the doll correctly and to distinguish between under-side of the cloth and front side, to match colors, and to learn the order of dressing (i.e. underwear, cloths and tops).

In the specific example illustrated in FIGS. 5A-5B, the kitchen toy for doll 500 comprises some components that are similar to corresponding components illustrated with reference to kitchen toy device 100 of FIG. 1, such as stove 110, flame heads 112, buttons 114 of the stove, a sink 120, tap 122 with a handle 121 and a drain hole 124, storage cabinet 144, oven 130, an extractor hood area 184 with hanging hooks 185 for hanging cooking tools 188, a wall 182 with a small screen 555, an electric kittle 174, a refrigerator 510, and a towel 145 hanged on it by a magnet.

Figure 6A:
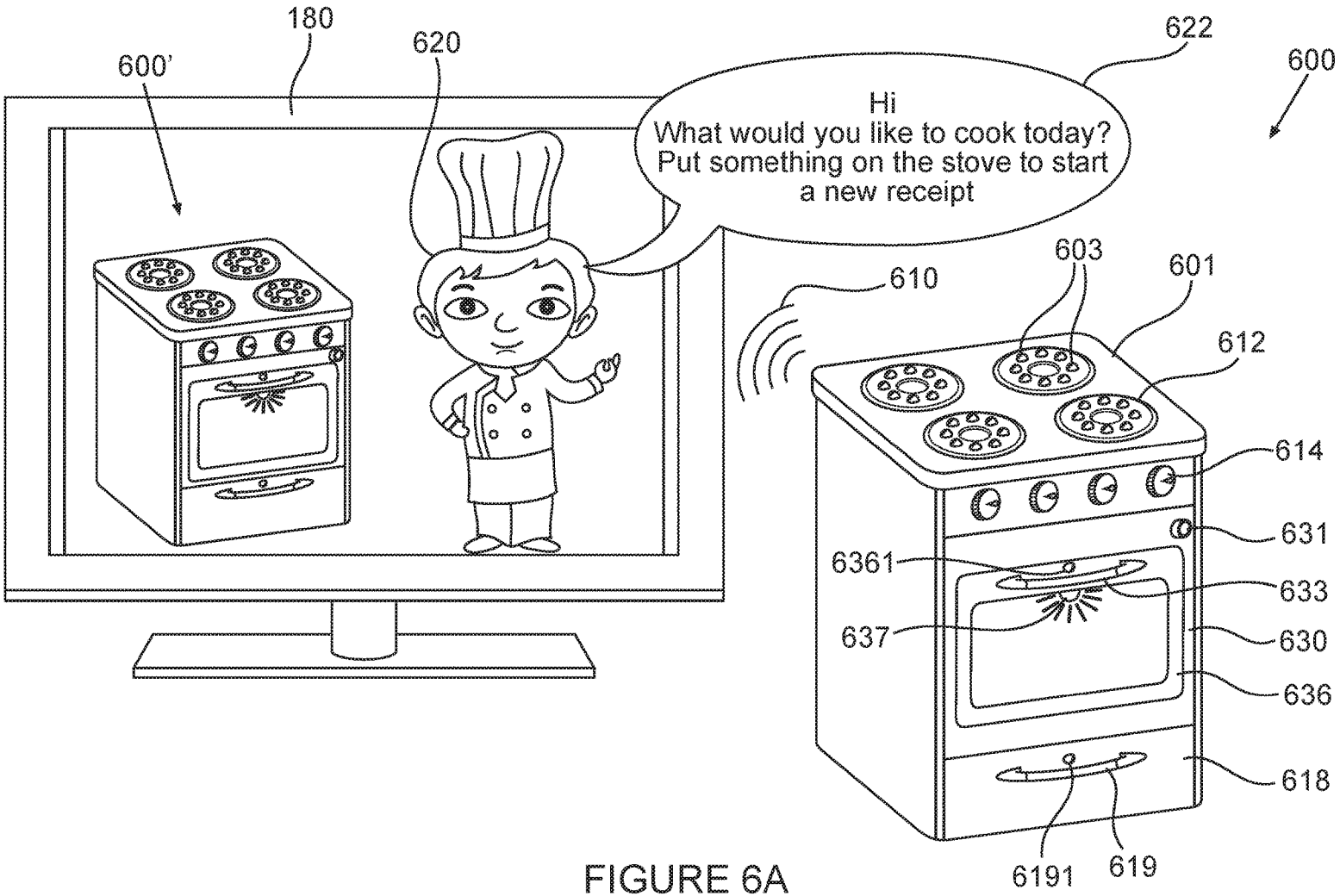
FIG. 6A-6B depict a connected stove and oven toy positioned one on top of the other in a traditional design and a connected smart television reflecting optional interactions between the physical toy and the supporting software app installed on the smart device.
Figure 6B:
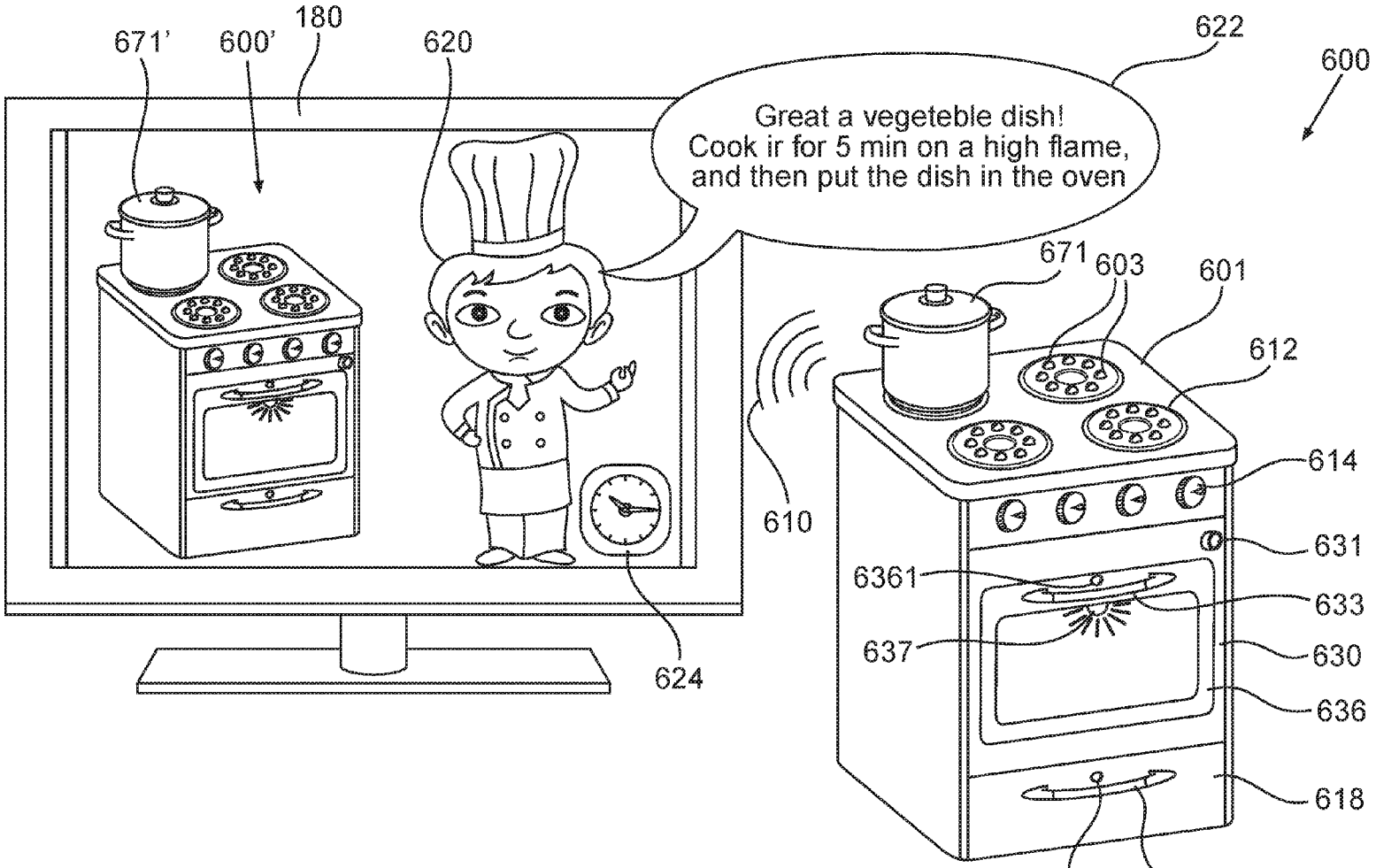

FIG. 6A-6B depict a connected kitchen toy device 600 comprising a stove 601 positioned on top of an oven 630 in a traditional design (6A) and a smart television 180 reflecting the connected kitchen toy device 601 with a virtual chef character 620. Stove 601 is functionally similar to the stove of FIG. 1 and comprises four flame heads 612 each having at least one LED 603, operation buttons 614 and a variety of identification sensors and means attached to its inner structure (not shown). Kitchen toy 600 comprises oven 630 with a door 636 and a handle 633 and further comprises a Hall-effect sensor 6361 implemented as a button attached to the inner surface of the door and configured to indicate whether the door is in an open/close position. Oven 630 further comprises an operation button 631 that may be implemented by a potentiometer. This button is configured to allow the player to set for example, the oven temperature, and a timer. Upon operation of the oven, a LED positioned inside the toy oven 637 may light up. Kitchen toy 600 further comprises a storage drawer 618 with a handle 619, and a sensor 6191 attached to the inner surface of the drawer to provide an indication of whether it is open or closed. Data created by the connected toy kitchen 600 is transmitted to the smart device 180 by wireless communication 610. Alternatively, communication may be performed via wires. In this specific example, the software app installed on the smart television includes a chef character 620 configured to guide the child and teach him, for example, about healthy food, the chemistry behind cooking, and assist the child to prepare meals. The app may further include educational values about food, and may add another dimension of learning to the game with physical toy kitchen. At the beginning of the game a communication bubble 622 may appear on the screen saying for example: "Hi! What would you like to cook today? Put something on the stove to start a new recipe". Alternatively, the sound may be played from an internal speaker on the kitchen toy device). Additionally or alternatively, this message may be produced from the smart device. The app may further instruct the player to put something on the stove. As the next step (FIG. 6B), the playing item that the player positioned on the stove are displayed in the virtual kitchen toy 600' on the smart device and another communication bubble 622 may appear on the screen, referring to the item that the child positioned on the stove. In the specific example illustrated in this figure, a pot 671 was placed on the stove and an image of it is displayed on the smart device (virtual stove 671'). Similarly, when the player inserts something into the oven, the inner LED on the physical toy device 600 and in the corresponding place in the virtual kitchen toy 600' displayed on the smart device is turned on. In addition, the app may display the oven with the identified item inserted into it on the screen. Also, a clock 624 may be displayed on the smart device and the time duration that the virtual food should be inside the oven.

Figure 7:
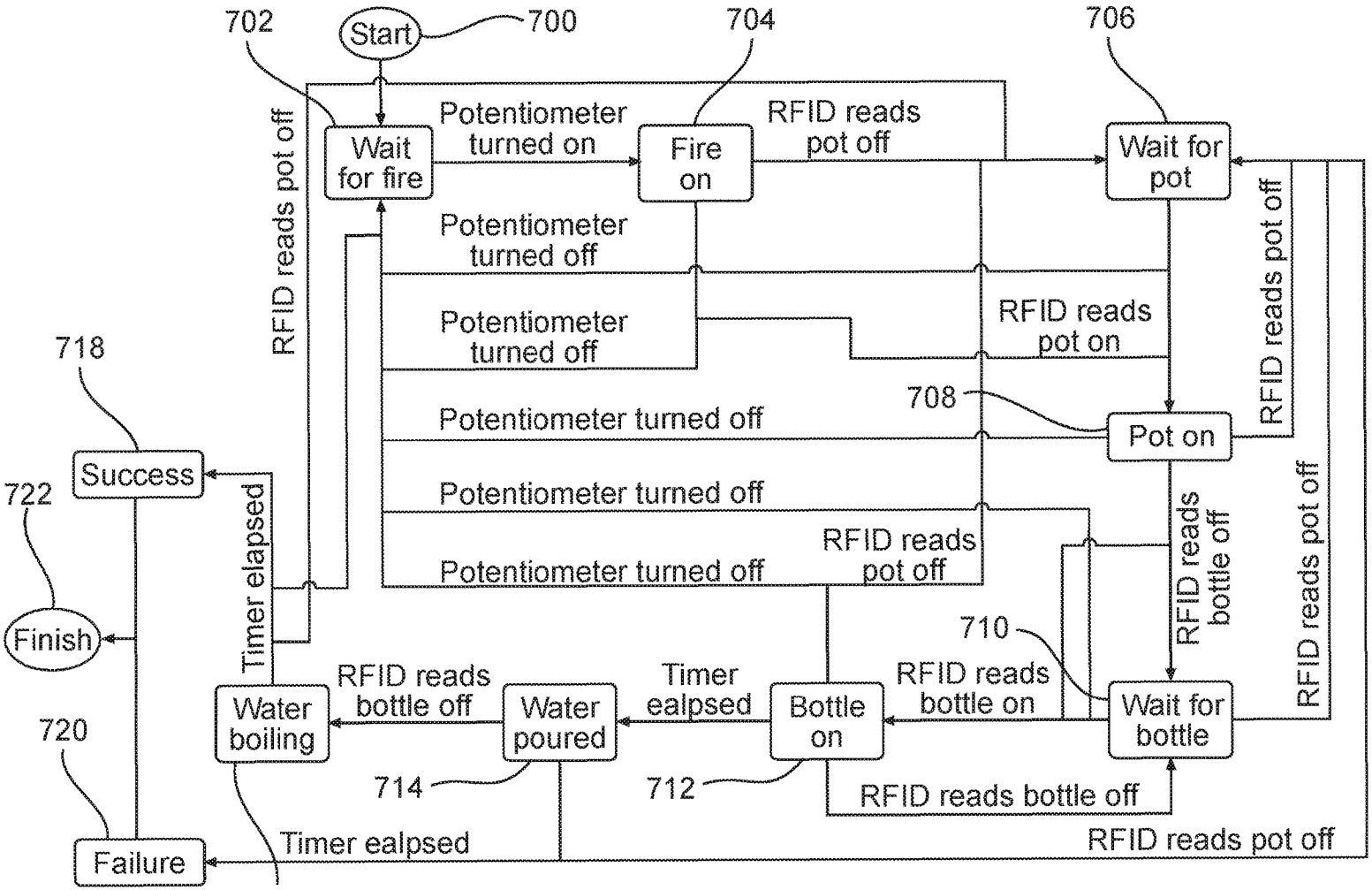
FIG. 7 is a state diagram illustrating an example of the sequence of commands performed by a dedicated software application installed on a smart device for the connected kitchen toy, based on real time analysis of the actions performed on the stove of the connected kitchen toy device by a player.

FIG. 7 is a state diagram illustrating an example of the sequence of commands performed by a dedicated software application installed on a smart device for the connected kitchen toy, based on real-time analysis of the actions performed on the stove of the connected kitchen toy device by a player. From start point (700), state one (702) "Wait for fire" instructs the user to turn the fire on a high flame, hence to turn the physical potentiometer cover (314*a*/314*b*/314*c* of FIG. 3A) above a specific value, which is connected to the potentiometer (3141*a*/3131*b*/3141*c* of FIG. 3A). Upon increase in the potentiometer value, the app moves to state two (704) "Fire on", in which the app provides a visual feedback on the smart device's screen of a flame in the virtual kitchen, and a sound effect of fire, and sends a command to the physical toy to turn on LED lights 303 in the corresponding stove port. In state three (706) "Wait for pot", if a pot 371 is not already placed on the stove, the app instructs the player to do so. On the other hand, if the application recognizes that pot 371 is positioned on the stove or was placed on the stove, it moves to state four (708) "Pot on" and present a corresponding feedback, such as an animation of the pot being placed on the virtual stove, and moves to state five (710) "Wait for bottle". In this state, if a bottle is not being brought to the stove, the app instructs the player to do so. In state six (712) "Bottle on", if the bottle is recognized by the corresponding RFID antenna 321 along with pot 314, the app provides feedback of the water being poured. In this state six, the application will keep pouring water into the pot until a timer runs out (elapsed) and the pot is filled with water in state seven (714) "Water poured", or the RFID tag of the bottle is no longer recognized by the RFID antenna 321, which means that the player has stopped pouring before time has run out, in which case the app returns to state five (710) "Wait for bottle". From state seven (714) "Water poured", if another timer runs out (elapsed) without the bottle being removed on time, then the app recognizes that too much water was poured and it goes to state ten (720) "Failure". However, if the bottle is removed on time, then the system goes to state eight (716) "Water boiling". Another timer determines when the water is boiled to go to state nine (718) "Success" to show feedback and turn LED lights off 303 at the finish point (722). At any state described in the above, a fallback is made upon removal of any of the existing objects from their original place. For example, in state four (708) "Pot on", if the fire is suddenly turned off potentiometer cover 314, the app goes back to state one (702) "Wait for fire", so the user will be instructed to turn the fire handle (potentiometer cover 314). When the user does so, the app will go to state two "Fire on" and then immediately to state three "Wait for pot" and afterwards back to state four "Pot on", where it came from in the first place.

It should be clear that the description of the embodiments and attached Figures set forth in this specification serves only for a better understanding of the invention, without limiting its scope. It should also be clear that a person skilled in the art, after reading the present specification could make adjustments or amendments to the attached Figures and above described embodiments that would still be covered by the present invention.

The invention claimed is:

1. A connected kitchen toy device in communication with at least one smart device having dedicated software for interaction with said kitchen toy device, said kitchen toy device configured to allow a player to imitate cooking in a real kitchen, said kitchen toy device comprising:

at least one playing item;

at least one input element to provide recognition of said at least one playing item;

at least one output element to provide a response to one or more commands;

at least one communication module for sending commands to said at least one output element, for receiving information related to one or more playing item from said at least one input element, and for allowing bi-directional communication between said kitchen toy and said smart device, said communication module allowing simultaneous transmission and receipt of data from said at least one playing item to said smart device and/or to said at least one input element or to said at least one output element;

wherein an action performed by said player on said playing item positioned on said kitchen toy device or held in its vicinity, and wherein the action performed by the player and the at least one playing item are both identified by said at least one input element, communicated to the smart device from the communication module, the action is displayed on said smart device and a reaction is communicated on either one of the output element of the kitchen toy device, the playing item, the smart device, or combinations thereof.

2. The connected kitchen toy device according to claim 1, wherein said playing item comprises at least one identification element configured to allow its recognition by at least one identification means positioned on said kitchen toy device, and wherein upon identification of said playing item, it is displayed on said smart device screen.

3. The connected kitchen toy device according to claim 2, wherein said playing item further comprises hardware and a motion sensor configured to allow identification of movements performed by the player with said playing item.

4. The connected kitchen toy device according to claim 1 wherein said playing item further comprises at least one output element.

5. The connected kitchen toy device according to claim 1, wherein said playing item and the action performed on/with it by the player are identified by a camera.

6. The connected kitchen toy device according to claim 1, wherein said playing item is identified by RFID technology.

7. The connected kitchen toy device according to claim 1, wherein said playing item is selected from the group consisting of: home use electrical appliance, vegetables, fruits, milk products, meat products, kitchen tools, eating tools, cooking and baking ingredients and tools, and baking products.

8. The connected kitchen toy device according to claim 1, wherein said action is a series of actions directed to preparation of a dish or a drink.

9. The connected kitchen toy device according to claim 1, wherein said input element is selected from the group consisting of: buttons, potentiometers, touch sensors, light sensor, color sensors, hall-effect sensors, audio sensors, odor sensors, motion sensors and temperature sensors and said at least one output element is selected from the group consisting of buttons, LEDs, potentiometers, piezoelectric sensors, touch sensors, smell sensors, light sensor, buzzer, speaker, microphone, and identification sensors.

10. The connected kitchen toy device according to claim 1, wherein said identification is obtained by identification acceptable technologies consisting of: RFID, NFC, capacitive sensors, hotspots, ultrasonic triangulation based sensors, sensors based on energy harvesting, weight sensors, photosensors, color sensors, gated buttons and a camera.

11. The connected kitchen toy device according to claim 1, wherein said reaction is a virtual reaction displayed on said smart device or a physical reaction produced by said kitchen toy device, or both.

12. The connected kitchen toy device according to claim 1, wherein said reaction is produced by said output elements and contains at least one of an audio output, a visual output, an odor output, and a mechanical output.

13. The connected kitchen toy device according to claim 12, wherein said audio output is selected from the group consisting of: a buzzer, a speaker, and a sound produced by the smart device, and said visual output is selected from: a light, a LED, an animation, a picture, an illustration displayed on the smart device or a dedicated screen on said kitchen toy device.

14. The connected kitchen toy device according to claim 1, further comprising at least one of: a toy sink configured to light up at least one LED simulating water flow upon performance of an action by said player, a toy stove with at least one flame head configured to light up at least one LED simulating fire, wherein a virtual sink with a water flow and/or a virtual stove with a flame are simultaneously displayed on said smart device's screen.

15. The connected kitchen toy device according to claim 14, wherein the water flow intensity and/or the flame intensity are modified according to the position of a sensor set by said player, wherein a virtual illustration reflecting the real-time intensity of said flow/flame intensity is displayed on said smart device.

16. The connected kitchen toy device according to claim 15, wherein said sensor is a potentiometer.

17. The connected kitchen toy device according to claim 15, wherein said flow/flame intensity is modified by the player on said smart device and the data is delivered via said communication module to the kitchen toy device to thereby create a corresponding change in real time on said kitchen toy device.

18. The connected kitchen toy device according to claim 1, wherein at least one output element is configured to be operated by said smart device to perform a physical reaction on said kitchen toy and/or playing item.

19. The connected kitchen toy device according to claim 1, wherein said smart device comprises dedicated software configured to analyze different states according to data obtained from said input elements, and to output a reaction according to a specific identified state.

20. The connected kitchen toy device according to claim 1, wherein said connected kitchen toy device is incorporated into a doll house toy or wherein said playing item is a doll.

21. A connected kitchen toy device in communication with at least one smart device having dedicated software for interaction with said kitchen toy device, said kitchen toy device configured to allow a player to imitate cooking in a real kitchen, said kitchen toy device comprising:

at least one playing item;

at least one input element to provide recognition of said at least one playing item, said input element being the smart device camera;

at least one output element to provide a response to one or more commands;

at least one communication module for sending commands to said at least one output element, for receiving information related to one or more playing item from said at least one input element, and for allowing bi-directional communication between said kitchen toy and said smart device;

wherein an action performed by said player on said playing item positioned on said kitchen toy device or held in its vicinity, and wherein the action performed by the player and the at least one playing item are both identified by said at least one input element, communicated to the smart device from the communication module, the action is displayed on said smart device and a reaction is communicated on either one of the output element of the kitchen toy device, the playing item, the smart device, or combinations thereof.

* * * * *